US009086666B2

(12) United States Patent
Takatsu

(10) Patent No.: US 9,086,666 B2
(45) Date of Patent: Jul. 21, 2015

(54) IMAGE FORMING APPARATUS HAVING A CONTROL UNIT THAT CONTROLS AN IMAGE BEARING MEMBER

(71) Applicant: CANON KABUSHIKI KAISHA, Tokyo (JP)

(72) Inventor: Junya Takatsu, Yachiyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/108,914

(22) Filed: Dec. 17, 2013

(65) Prior Publication Data

US 2014/0178101 A1 Jun. 26, 2014

(30) Foreign Application Priority Data

Dec. 18, 2012 (JP) ..... 2012-275679

(51) Int. Cl.
*G03G 15/00* (2006.01)
*G03G 15/16* (2006.01)

(52) U.S. Cl.
CPC ..... *G03G 15/505* (2013.01); *G03G 15/1615* (2013.01); *G03G 2215/0129* (2013.01)

(58) Field of Classification Search
CPC . G03G 15/1615; G03G 15/50; G03G 15/505; G03G 15/5008; G03G 15/759; G03G 2215/0129
USPC ..... 399/167, 302, 308
See application file for complete search history.

(56) References Cited

U.S. PATENT DOCUMENTS

| | | | | |
|---|---|---|---|---|
| 5,995,802 | A | 11/1999 | Mori et al. | |
| 2006/0088345 | A1 | 4/2006 | Koizumi | |
| 2007/0280734 | A1 | 12/2007 | Yahagi | |
| 2008/0107449 | A1 | 5/2008 | Oohara | |
| 2013/0017006 | A1 * | 1/2013 | Suda | 399/346 |
| 2013/0058683 | A1 * | 3/2013 | Doshida | 399/167 |
| 2014/0168338 | A1 * | 6/2014 | Yano et al. | 347/116 |

FOREIGN PATENT DOCUMENTS

JP 2002-333752 A 11/2002

* cited by examiner

*Primary Examiner* — Sophia S Chen
(74) *Attorney, Agent, or Firm* — Canon USA, Inc. IP Division

(57) ABSTRACT

An image forming apparatus includes an intermediate transfer member configured to rotate an image bearing member by contacting and operating the image bearing member, an image bearing member drive unit configured to drive the image bearing member, a control unit configured to output a torque instruction value to the image bearing member drive unit to control an assist torque generated by the image bearing member drive unit, and a measurement unit configured to measure a maximum speed and a minimum speed of the surface of the image bearing member, wherein the control unit controls the image bearing member drive unit using a new torque instruction value determined based on torque instruction values respectively corresponding to a maximum speed and a minimum speed when controlling the image bearing member drive unit so that the maximum speed and the minimum speed are included in a range.

20 Claims, 24 Drawing Sheets

IMAGE FORMING APPARATUS HAVING A CONTROL UNIT THAT CONTROLS AN IMAGE BEARING MEMBER

BACKGROUND OF THE INVENTION

1. Field of the Invention

The present invention relates to an image forming apparatus employing an electrophotographic method.

2. Description of the Related Art

An electrophotographic image forming apparatus includes a photosensitive drum, i.e., an image bearing member bearing a toner image, and an intermediate transfer belt (ITB), i.e., an intermediate transfer member. Further, it is necessary for such an image forming apparatus to drive the photosensitive drum and the ITB so that surface speeds thereof are constant.

More specifically, it is necessary for the surface speeds to be constant for the following reasons. Laser exposure which is performed for forming an electrostatic latent image on the photosensitive drum may be time synchronization exposure. In such a case, a change in the surface speed of the photosensitive drum causes a laser irradiation position to be displaced from the intended position.

Further, in a primary transfer process, a toner image formed on the photosensitive drum is transferred to the ITB. In such a case, if there is a periodic speed difference between the surface speeds of the photosensitive drum and the ITB, the position of the toner image transferred to the ITB becomes displaced from the intended transfer position.

As a result, image failure occurs with respect to an image output to recording paper, such as color misregistration between the colors, and banding, i.e., a periodic positional displacement.

To solve such a problem, various speed detection sensors are used in performing drive control of the photosensitive drum and the ITB. Speed feedback control is thus performed on motors driving the photosensitive drum and the ITB to realize a highly accurate constant speed. A brushless direct current (DC) motor (BLDC motor) is often used as the motor due to low cost, quietness, and high efficiency thereof.

In recent years, speed feedback control using the BLDC motor has been performed as follows. A rotary encoder is arranged on a drum shaft, and motor control is performed to control a rotation speed of the drum shaft to be constant.

In the above-described method of speed feedback control, the rotation speed of the drum shaft is detected. However, since the surface speed of the photosensitive drum is not detected, it is difficult to control the surface speed of the photosensitive drum to be constant due to eccentricity of the drum shaft, and accuracy of a drum diameter.

Further, it is similarly difficult to control the surface speed of the ITB to be constant due to eccentricity of a shaft of an ITB drive roller 110 (illustrated in FIG. 1) which drives the ITB, the accuracy of a roller diameter, and unevenness in the thickness of the ITB.

Furthermore, mutual interference due to friction between the photosensitive drum and a transfer surface of the ITB may cause the image failure. More specifically, speed fluctuation in one of the photosensitive drum and the ITB is transferred to the other, and thus causes such a mutual interference.

Moreover, if the toner image formed on the ITB is to be transferred to a cardboard in a secondary transfer process, a sudden change in a load on the ITB occurs so that high-frequency speed fluctuation is generated. The high-frequency speed fluctuation then causes the positional displacement in the secondary transfer.

As described above, there are various causes of the image failure, and it is extremely difficult to solve all of the problems.

Japanese Patent Application Laid-Open No. 2002-333752 discusses such a configuration that an image bearing member corresponding to the photosensitive drum is driven with friction by an image transfer member corresponding to the ITB. In this configuration, an image is formed based on a position reference of the photosensitive drum for the image developed on the photosensitive drum to become an image on the ITB. An effect of unevenness in the rotation of the photosensitive drum can thus be reduced.

Further, according to the technique discussed in Japanese Patent Application Laid-Open No. 2002-333752, the image developed on the photosensitive drum becomes the image on the ITB even if there is the speed fluctuation of the ITB due to an impact on the ITB when the recording paper enters a secondary transfer unit. As a result, the image failure does not occur in the primary transfer.

However, as discussed in Japanese Patent Application Laid-Open No. 2002-333752, it is necessary to increase transfer pressure in the primary transfer to realize the driven operation of the photosensitive drum with friction. If the transfer pressure is increased, the load generated on the photosensitive drum and the ITB increases, so that an amount of torque in the motor increases and thus has an adverse effect on transferability of toner.

On the other hand, if the driven operation is realized without increasing the transfer pressure, a difference between the rotation speeds of the photosensitive drum and the ITB is generated with time due to a load change on the photosensitive drum. The driven operation thus cannot be continued.

SUMMARY OF THE INVENTION

The present disclosure is directed to an image forming apparatus capable of continuing to perform the driven operation of the image bearing member with the intermediate transfer member.

According to an aspect disclosed herein, an image forming apparatus includes an image bearing member configured to be rotatable and to allow a toner image to be formed on a surface thereof, an intermediate transfer member configured to rotate the image bearing member by contacting and operating the image bearing member to be driven, and to receive the toner image transferred from the image bearing member, an image bearing member drive unit configured to drive the image bearing member by generating an assist torque for operating the image bearing member to be driven, a control unit configured to output a torque instruction value to the image bearing member drive unit to control the assist torque generated by the image bearing member drive unit, and a measurement unit configured to measure a maximum speed and a minimum speed of the surface of the image bearing member rotating, wherein the control unit controls the image bearing member drive unit using a new torque instruction value determined based on torque instruction values respectively corresponding to a maximum speed and a minimum speed when controlling the image bearing member drive unit so that the maximum speed and the minimum speed measured by the measurement unit are included in a range which is predetermined according to a target speed of the image bearing member.

Further features of the present invention will become apparent from the following description of exemplary embodiments with reference to the attached drawings.

DESCRIPTION OF THE EMBODIMENTS

Various exemplary embodiments, features, and aspects of the invention will be described in detail below with reference to the drawings.

Figure 1:
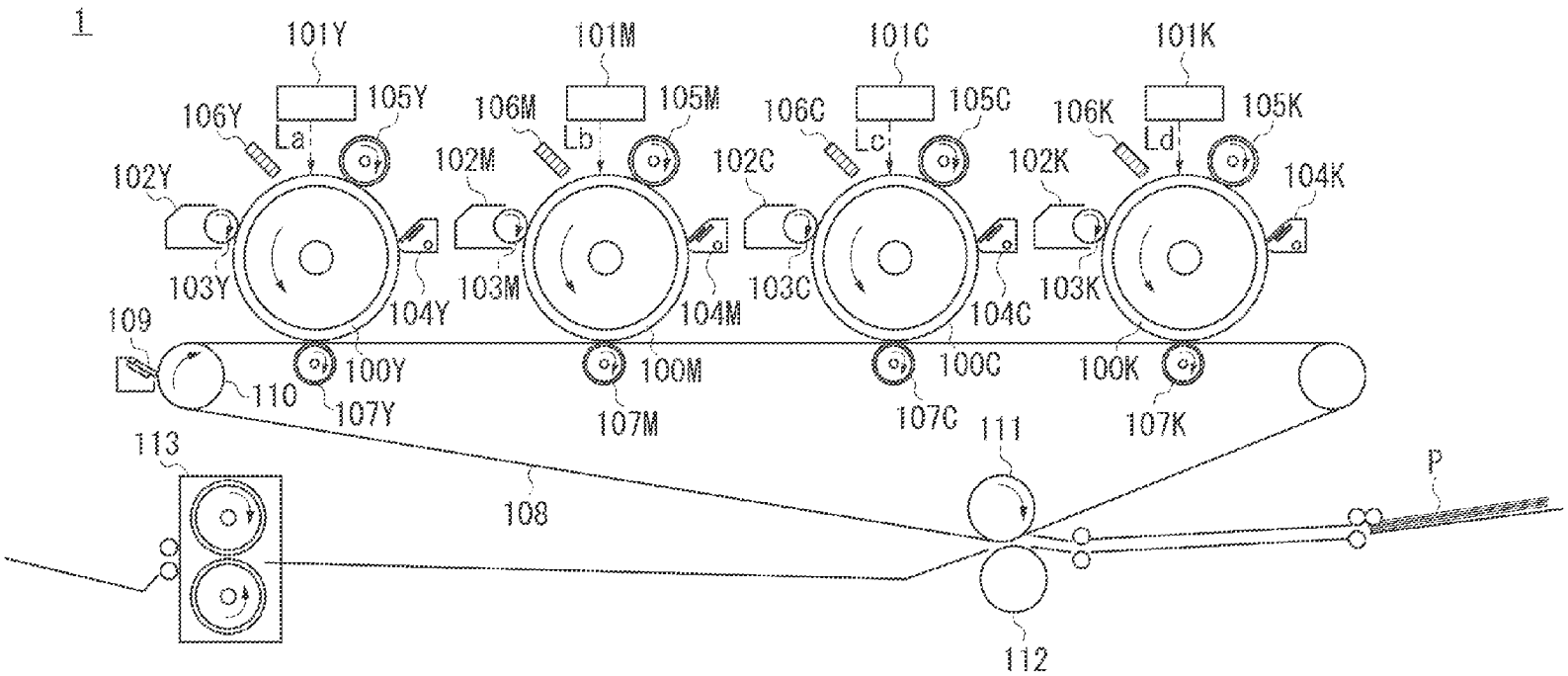
FIG. 1 is a schematic diagram illustrating a configuration of an image forming apparatus according to an exemplary embodiment of the present invention.

FIG. 1 is a schematic diagram illustrating a configuration of an image forming apparatus 1 according to an exemplary embodiment.

Referring to FIG. 1, the image forming apparatus 1 is capable of forming an image of four colors, i.e., yellow (Y), magenta (M), cyan (C), and black (K).

Reference numerals including Y, M, C, and K are used for indicating components corresponding to the respective colors Y, M, C, and K in FIG. 1. However, the components will be described below by omitting Y, M, C, and K in the reference numerals unless it is necessary to distinguish the components.

The image forming apparatus 1 receives a command from an upper-level CPU to be described below to form an image on recording paper P. A photosensitive drum 100 (i.e., an image bearing member), an intermediate transfer belt 108 (i.e., an intermediate transfer member, hereinafter referred to as ITB), a charging roller 105, a developing sleeve 103, a primary transfer roller 107, a secondary transfer inner roller 111, and a fixing unit 113 then start to rotate.

The charging roller 105 is connected to a high-voltage power source (not illustrated), and is applied a high voltage which is a direct current voltage, or a sine wave voltage superimposed on a direct current voltage. As a result, the surface of the photosensitive drum 100 contacting the charging roller 105 is uniformly charged to a potential which is the same as the direct voltage applied from the high-voltage power source.

An exposure device 101 exposes the charged surface of the photosensitive drum 100 at a laser irradiation position according to an image signal. The electrostatic latent image is thus formed on the surface of the photosensitive drum 100. A developing unit 102 then applies to the developing sleeve 103 a high voltage in which the sine wave voltage is superimposed on the direct current voltage.

The toner (i.e., color material) of negative charge is thus developed on the electrostatic latent image formed on the photosensitive drum 100. The potential of the electrostatic latent image is positive with respect to the high voltage applied to the developing sleeve 103 and negative with respective to the ground (GND). The rotatable photosensitive drum 100 then rotates towards the primary transfer roller 107.

The primary transfer roller 107 superimposes and transfers to the ITB 108 the toner images respectively developed on the four photosensitive drums 100. Further, the secondary transfer inner roller 111 and a secondary transfer outer roller 112 transfer the superimposed toner images to the recording paper P. The high-voltage power source (not illustrated) applies to the primary transfer roller 107 and the secondary transfer inner roller 111 the direct current high voltage for transferring the toner images.

A cleaner blade 104 sweeps and collects the transfer residual toner remaining on the photosensitive drum 100. Further, an ITB cleaner 109 sweeps and collects the transfer residual toner remaining on the ITB 108. The fixing device 113 applies pressing force and heat to the toner image transferred to the recording paper P and thus fixes the toner image on the recording paper P. The color image is thus formed on the recording paper P.

Further, the image forming apparatus 1 includes a surface position detection unit 106 for detecting the surface position of the photosensitive drum 100.

Figure 2:
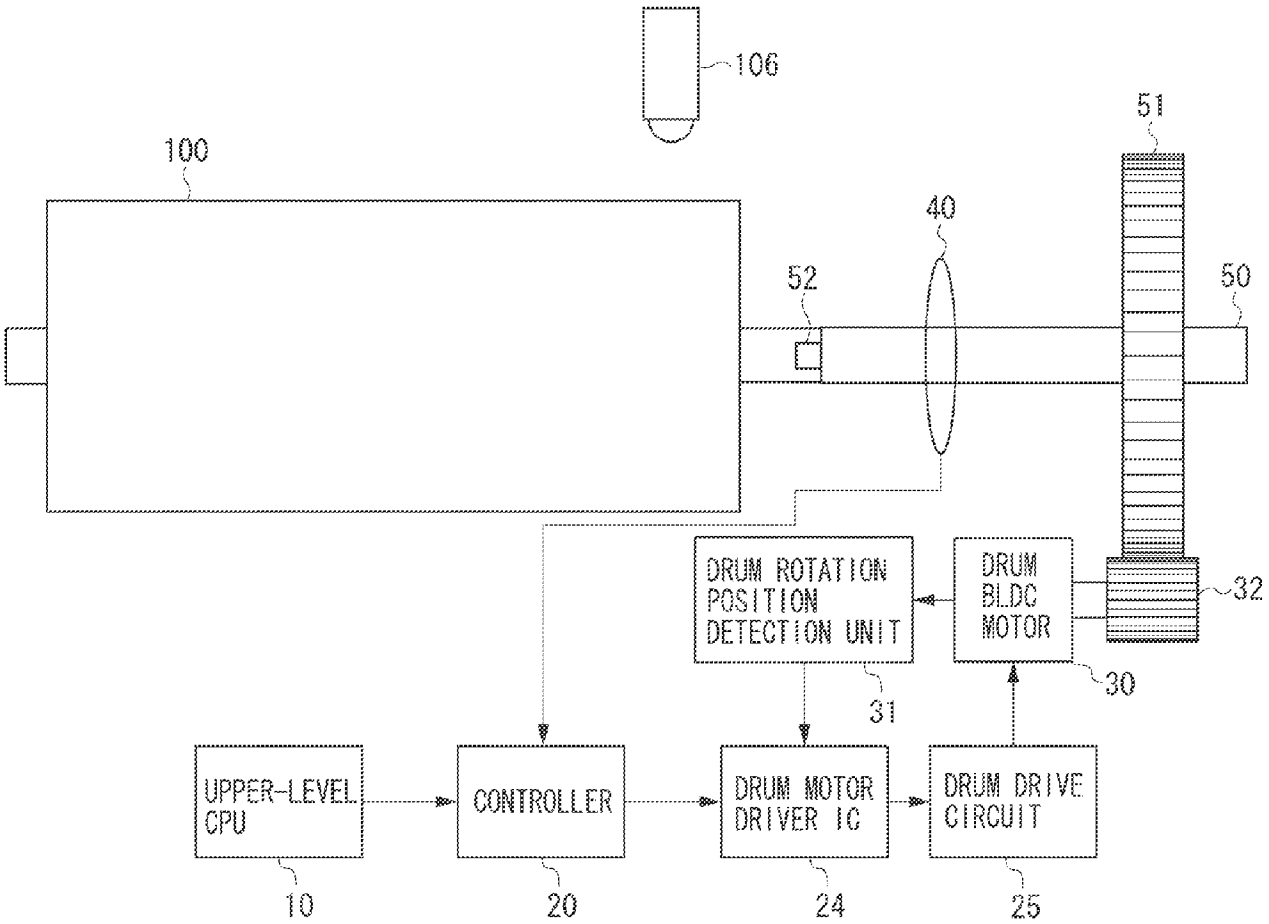
FIG. 2 illustrates a drive configuration of the photosensitive drum illustrated in FIG. 1.

FIG. 2 illustrates the drive configuration of the photosensitive drum illustrated in FIG. 1.

Referring to FIG. 2, the photosensitive drum 100 is mechanically connected to a drum shaft 50 via a coupling 52. Further, a drum reduction gear 51 and a drum rotary encoder 40 for detecting the rotation speed of the drum shaft are fixedly-arranged on the drum shaft 50.

A driving force from a drum BLDC motor 30, i.e., the driving source, is transmitted to the drum shaft 50 via meshing of a drum motor shaft gear 32 and the drum reduction gear 51. A controller 20 receives, from an upper-level CPU 10, instruction signals indicating driving on and off and indicating register setting values. The controller 20 then outputs to a drum motor driver integrated chip (IC) 24 various control signals such as switching driving on and off and a pulse-width modulation (PWM) signal.

A duty ratio is obtained by dividing a segment in which the PWM signal is of a high level by one period of the signal, and is expressed in percent. The duty ratio is proportional to rotation torque of the drum BLDC motor 30. According to the present exemplary embodiment, conventional speed feedback control is not performed. In other words, the duty ratio is not adjusted for the surface speed of the photosensitive drum 100 to become a processing speed (hereinafter referred to as a target speed). The details thereof will be described below. According to the present exemplary embodiment, the photosensitive drum 100 is driven by inputting to the drum motor driver IC 24 a predetermined duty ratio as the torque instruction value.

The drum motor driver IC 24 performs, via a drum drive circuit 25, phase switching of a phase current to be generated in the drum BLDC motor 30 and adjustment of the amount of current. The drum motor driver IC 24 performs such operations based on the control signal from the controller 20 and a rotation position signal from a drum rotation position detection unit 31.

The drum BLDC motor 30, the drum drive circuit 25, and the drum motor driver IC 24 correspond to an image bearing member drive unit which drives the photosensitive drum 100 by generating the assist torque for operating the photosensitive drum 100 to be driven. Further, the controller 20 corresponds to a control unit which outputs a torque instruction value to and controls the torque generated in the image bearing member drive unit. Furthermore, the controller 20 measures the surface speed of the photosensitive drum 100 using the drum rotary encoder 40.

Figure 3:
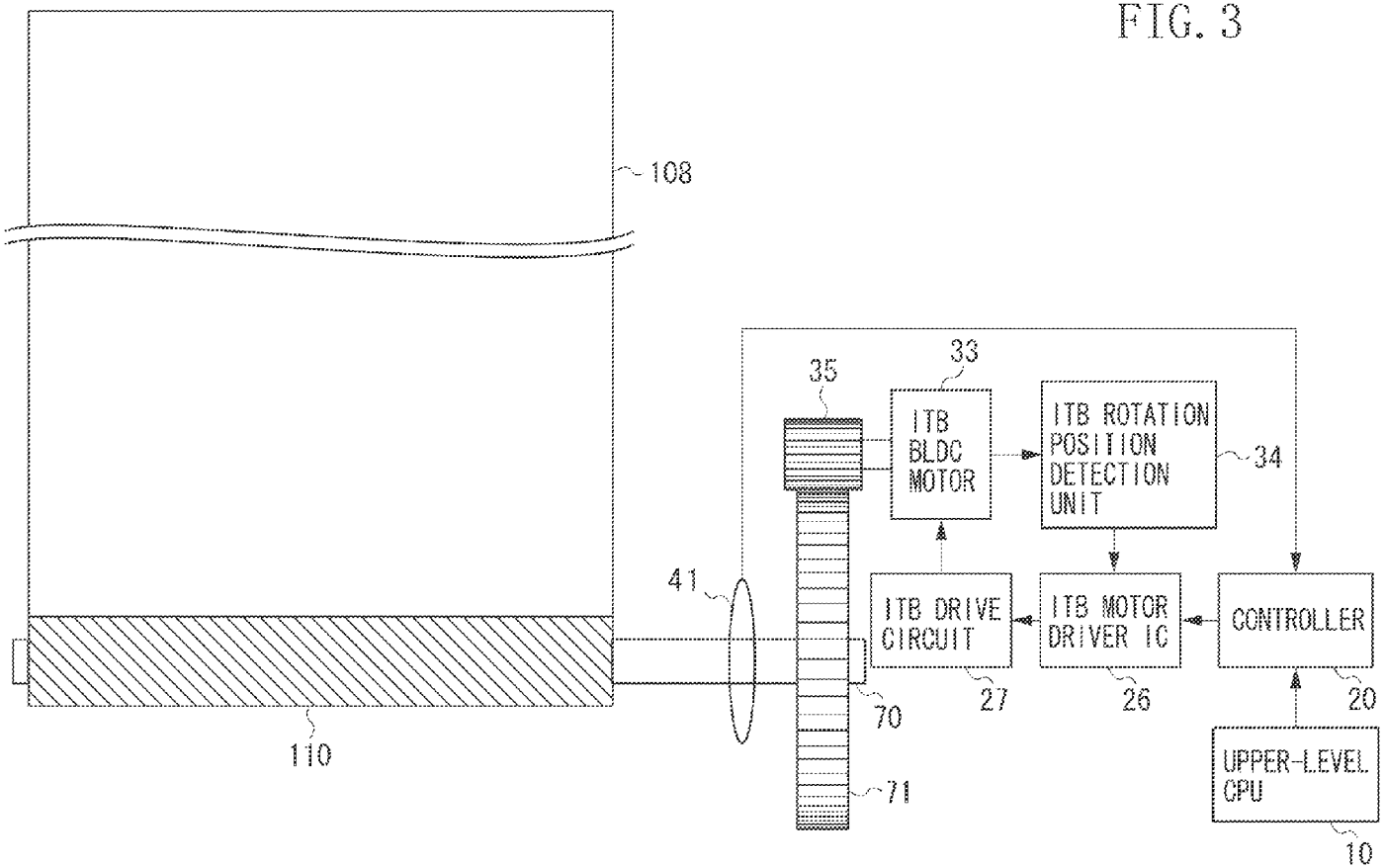
FIG. 3 illustrates a drive configuration of the ITB illustrated in FIG. 1.

FIG. 3 illustrates the drive configuration of the ITB 108 illustrated in FIG. 1.

Referring to FIG. 3, the ITB 108 is driven by rotationally driving an ITB drive roller 110 arranged to contact an inner side of the ITB 108. An ITB reduction gear 71 and an ITB rotary encoder 41 are fixedly-arranged on an ITB drive roller shaft 70. The ITB drive roller 110 is thus rotated by reducing the rotation speed of the ITG BLDC motor 33 using the ITB reduction gear 71 contacting the ITB motor shaft gear 35, similarly as the photosensitive drum 100.

The controller 20 receives, from the upper-level CPU 10, the instruction signals for switching driving on and off and the register setting values. The controller 20 then outputs to an ITB motor driver IC 26 the various control signals such as switching driving on and off and the PWM signal. The ITB 108 performs speed feedback control using an ITB rotation position detection unit 34 so that the surface speed becomes the target speed, which is different from the photosensitive drum 100.

The ITB motor driver IC 26 performs, via an ITB drive circuit 27, phase switching of the phase current to be generated in the ITB BLDC motor 33 and adjustment of the amount of current. The ITB motor driver IC 27 performs such operations based on the control signal from the controller 20 and the rotation position signal from the ITB rotation position detection unit 34. Further, the ITB 108 does not include the surface position detection unit 106.

Figure 4:
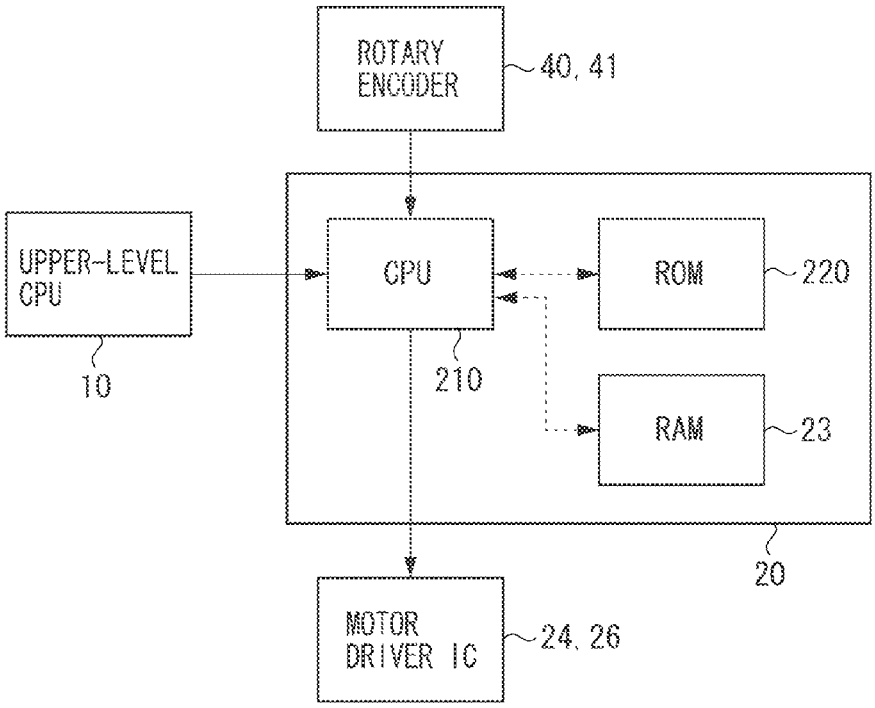
FIG. 4 is a schematic diagram illustrating a configuration of a controller illustrated in FIG. 2.

FIG. 4 is a schematic diagram illustrating the configuration of the controller 20 illustrated in FIG. 2.

Referring to FIG. 4, the controller 20 includes a CPU 210, a read-only memory (ROM) 220, and a random access memory (RAM) 23. The ROM 220 stores the duty ratio of the assist torque to be described below. The assist torque is derived as an optimal value at time of shipment. When the image forming apparatus is initially shipped, the CPU 210 reads the duty ratio from the ROM 220, inputs to the drum motor driver IC 24 the read duty ratio as the duty ratio of the PWM signal, and outputs constant assist torque to the drum BLDC motor 30.

If the optimal assist torque is newly derived by performing adjustment, the duty ratio thereof is stored in the RAM 23. When the duty ratio is stored in the RAM 23, the CPU 210 does not read the duty ratio from the ROM 220. Further, the CPU 210 calculates the surface speed of the photosensitive drum 100 using a speed detection signal output from the drum rotary encoder 40.

Figure 5:
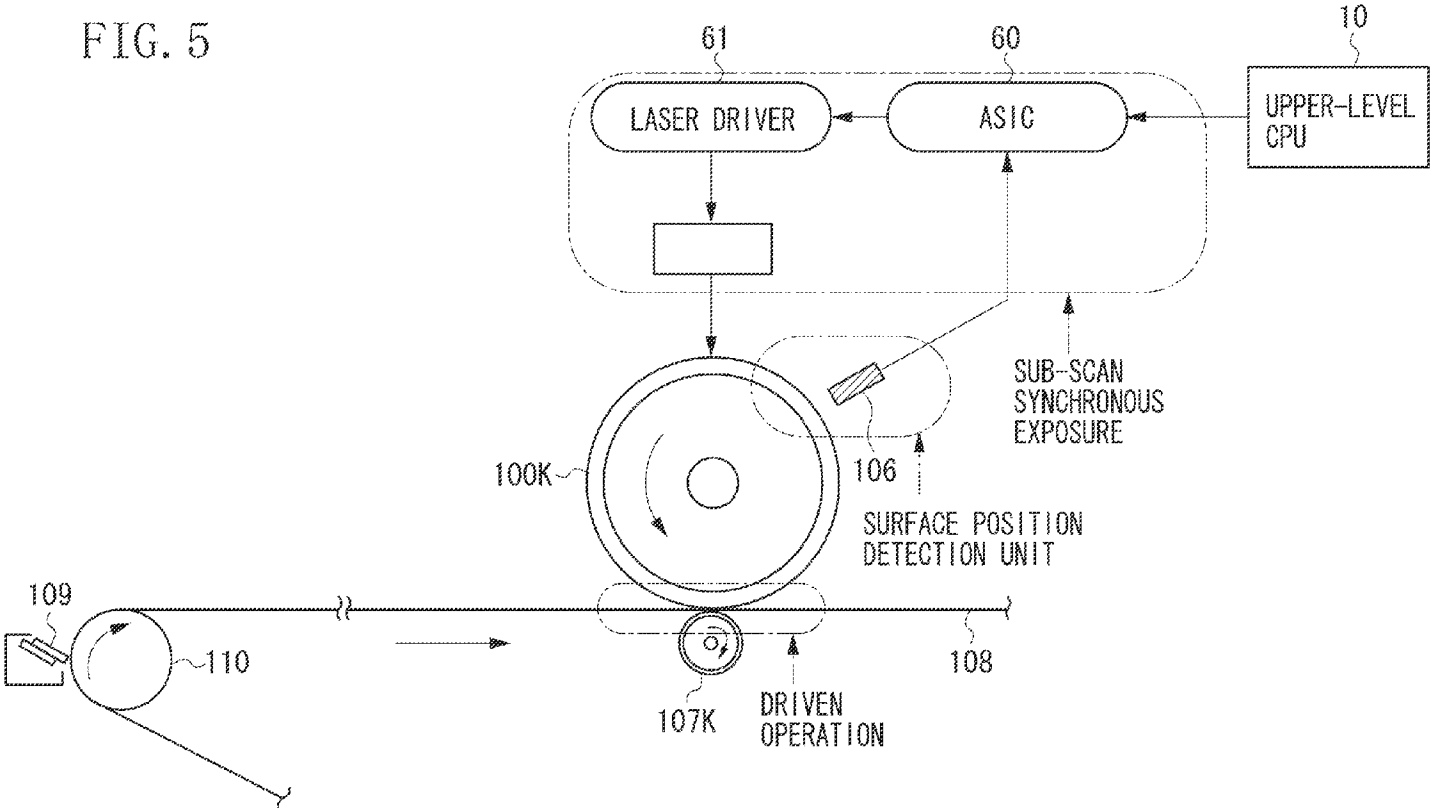
FIG. 5 illustrates the driven operation performed by the photosensitive drum and the ITB.

FIG. 5 illustrates the driven operation performed by the photosensitive drum 100 and the ITB 108.

Referring to FIG. 5, cross sections of the photosensitive drum 100 and the ITB 108 are illustrated for describing the process including exposure control.

The photosensitive drum 100 is operated to be driven according to the surface speed of the ITB 108. The driven operation will be described below. An exposure device 101K (FIG. 1) detects the surface position of the photosensitive drum 100 using the surface position detection unit 106 and performs exposure control in synchronization with the surface position (i.e., sub-scan synchronization exposure). The exposure device 101K is thus controlled to draw the electrostatic latent image on the photosensitive drum 100. A similar process is performed on the other photosensitive drums 100 (i.e., Y, M, and C photosensitive drums).

An application specific IC (ASIC) 60 controls timing of outputting exposure signals to a laser driver 61 for drawing a print image.

The above-described driven operation indicates driving the ITB 108 and the photosensitive drum 100 so that the surface speeds thereof are constantly the same. The driven operation is performed by the ITB 108 causing the photosensitive drum 100 to rotate along with the rotation thereof, using a frictional force between the ITB 108 and the photosensitive drum 100.

In such a case, speed feedback control is performed so that the ITB 108 is controlled to be driven at a constant speed. Further, the photosensitive drum 100 is driven according to a predetermined duty ratio. The duty ratio is proportional to the size of the torque when the photosensitive drum 100 is stably rotating, and is uniquely determined. More specifically, the duty ratio indicates a period in which an applied voltage is switched on, and the drum motor driver IC 24 generates the electric current in the motor during such a period. As a result, the duty ratio is proportional to the current. Since the current and the torque are proximately proportional to each other in the drum BLDC motor 30, the duty ratio and the torque are also proportional.

In other words, the driven operation can be performed by adjusting the predetermined torque for rotating the photosensitive drum 100.

Figure 6:
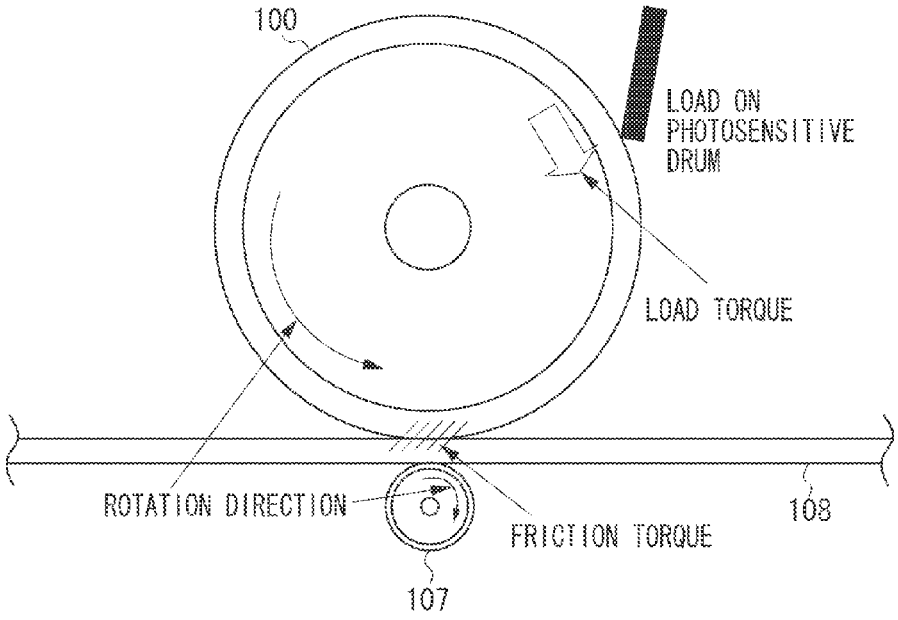
FIG. 6 illustrates load torque generated in the photosensitive drum and friction torque generated by contact surfaces of the photosensitive drum and the ITB.

FIG. 6 illustrates the load torque generated in the photosensitive drum 100 and the friction torque generated by the contact surfaces of the photosensitive drum 100 and the ITB 108.

Referring to FIG. 6, the load torque is a value obtained by adding the load torque generated by the cleaner blade 104 and the load torque generated on a drum bearing in a rotational operation while performing an image forming process. The load torque does not include the friction torque between the photosensitive drum 100 and the ITB 108 generated on the contact surface with the ITB 108 (hereinafter referred to as the friction torque).

Figure 7:
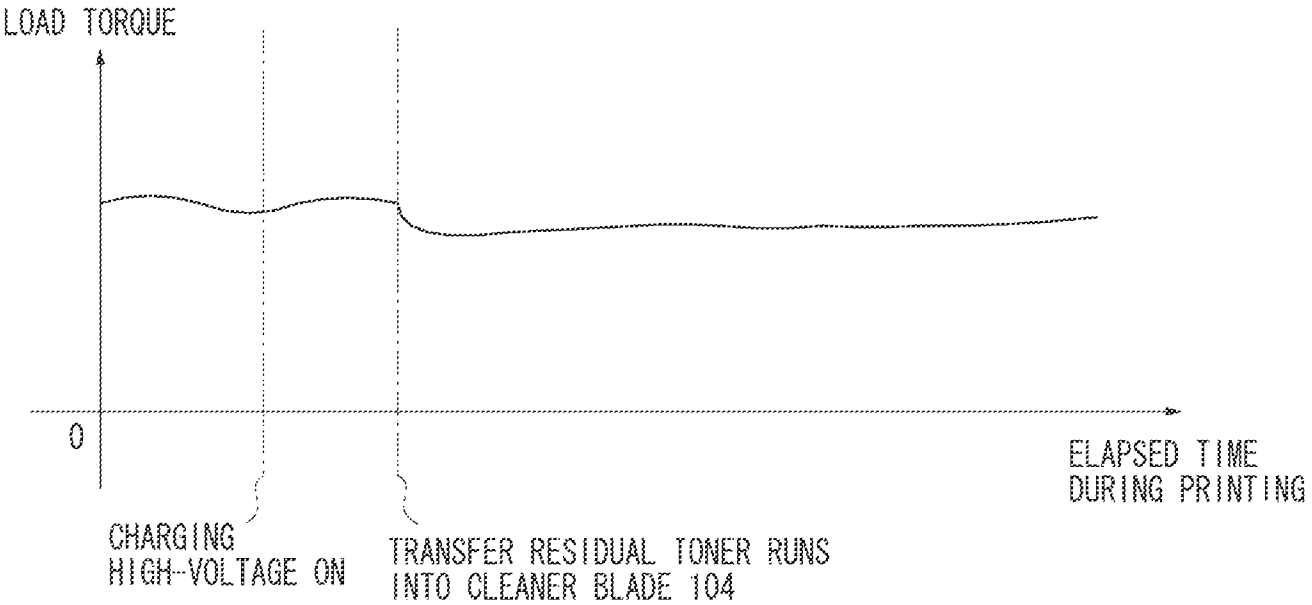
FIG. 7 illustrates a change in the load torque during a print process.

FIG. 7 illustrates the change in the load torque during the print process.

Referring to FIG. 7, the load torque is indicated on the vertical axis, and elapsed time is indicated on the horizontal axis. The example of FIG. 7 illustrates that the load torque is not constant, and changes at the timing when a charge voltage is applied, or at the timing when the residual toner that has not been transferred runs into the cleaner blade 104.

However, such torque which transitionally changes (hereinafter referred to as fluctuating torque) is sufficiently small as compared to the constantly generated load torque. Further, since a stationary component of the load torque is extremely large as compared to the friction torque, the ITB 108 cannot operate the photosensitive drum 100 to be driven using the friction torque.

To solve such a problem, the drum BLDC motor 30 generates, in the photosensitive drum 100, rotation torque equivalent to the stationary component of the load torque, to cancel the stationary component of the load torque. Such rotation torque is the above-described assist torque.

Figure 8:
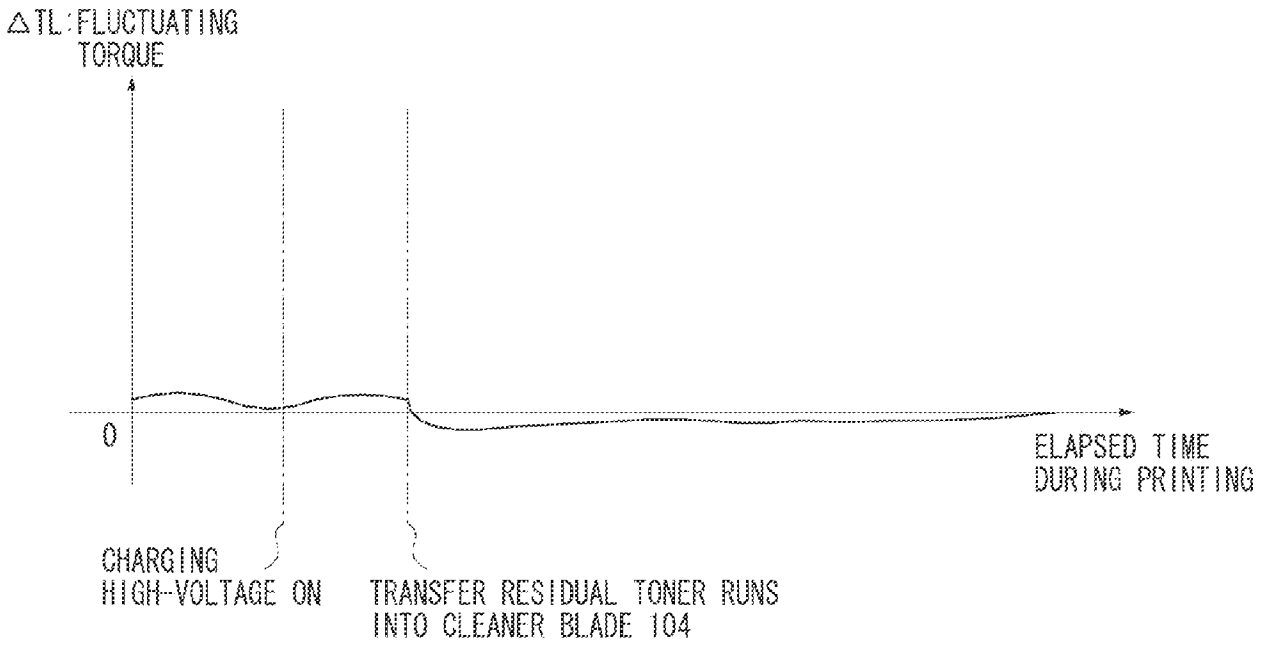
FIG. 8 illustrates a change in the torque in the photosensitive drum which occurs when assist torque is generated.

FIG. 8 illustrates the change in the torque in the photosensitive drum 100 when the assist torque is generated.

Referring to FIG. 8, the fluctuating torque is indicated on the vertical axis, and the elapsed time is indicated on the horizontal axis. The example of FIG. 8 illustrates that the fluctuating torque generated in the photosensitive drum 100 decreases. As a result, the photosensitive drum 100 can be easily operated to be driven. Further, if the photosensitive drum 100 is to be driven according to the speed fluctuation of the ITB 108, it becomes necessary to add acceleration torque expressed by a product between a drum inertia of the drum shaft 50 and acceleration. The drum inertia is a total load which rotates, expressed as an inertia component of the drum shaft 50.

Figure 9:
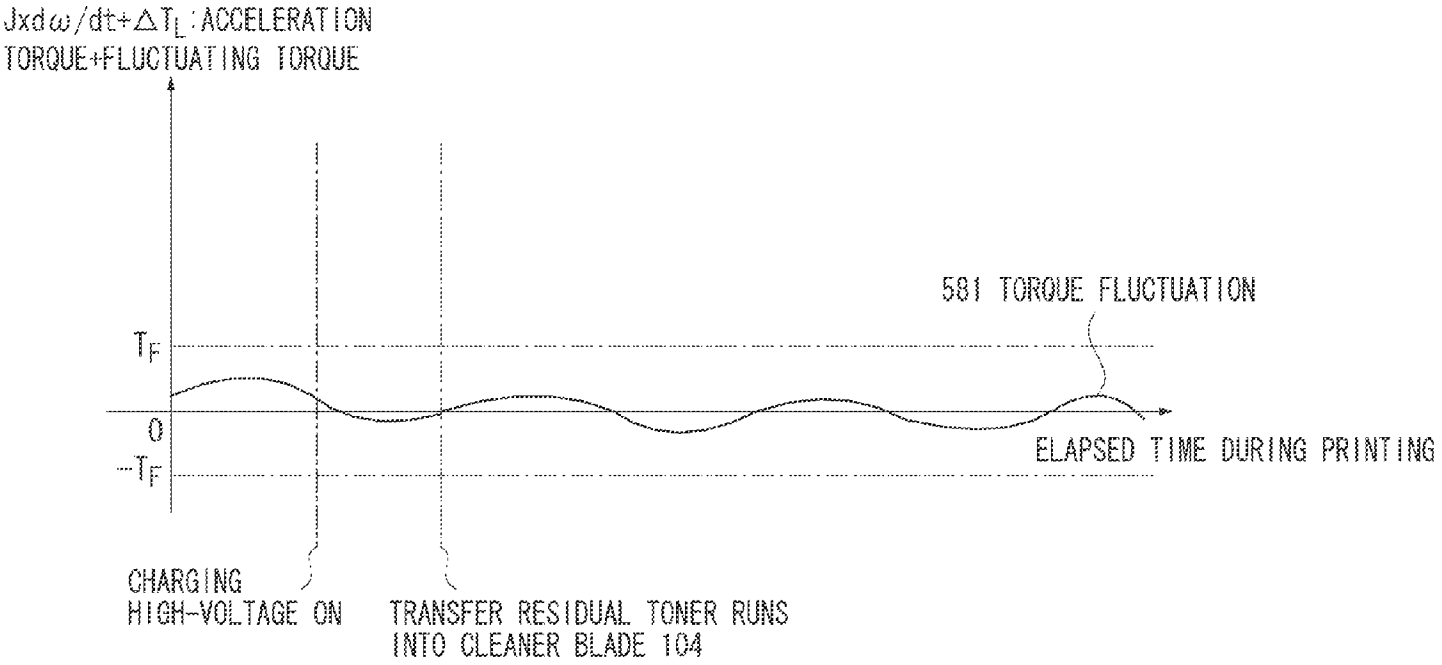
FIG. 9 illustrates a change in fluctuating torque when the driven operation can be performed.

FIG. 9 illustrates the change in the fluctuating torque in the case where the photosensitive drum 100 can be operated to be driven.

Referring to FIG. 9, the sum of the acceleration torque and the fluctuating torque is indicated on the vertical axis, and the elapsed time is indicated on the horizontal axis. The example of FIG. 9 illustrates that torque fluctuation 581 which is the sum of the acceleration torque and the fluctuating torque of the photosensitive drum 100 is less than or equal to the friction torque. In such a case, the photosensitive drum 100 can be operated to be driven. When the surface speeds of the photosensitive drum 100 and the ITB 108 match each other, the friction torque corresponds to a static friction coefficient.

The generated friction force applies power so that there is no difference between the surface speeds of the photosensitive drum 100 and the ITB 108, and the size thereof changes. In such a case, maximum torque which prevents the difference between the surface speeds to be generated is maximum static friction torque. The maximum static friction torque can be indicated as follows using equations of motion.

$$|T_F| \geq J \times \frac{d\omega}{dt} + T_L. \tag{1}$$

$$|T_F| \geq J \times \frac{d\omega}{dt} + T_L - T_{AS} \tag{2}$$

$$|T_F| \geq J \times \frac{d\omega}{dt} + \Delta T_L \tag{3}$$

In the above-described equations, $T_F$ is friction torque, J is drum inertia, dω/dt is photosensitce drum angle accleration, $T_L$ is load torque, $T_{AS}$ is assist torque, and $\Delta T_L$ is fluctuating torque component.

Equation (1) indicates that, if the friction torque is greater than the sum of the acceleration torque, i.e., a first item on the right-hand, and the load torque, i.e., a second item on the right-hand, the photosensitive drum 100 is operated to be driven. However, since $T_F \ll T_L$ in actual terms, the photosensitive drum 100 is not operated to be driven.

The equations (2) and (3) are the equations of motion when the assist torque for cancelling the stationary component of the load torque is generated by the drum BLDC motor 30.

As a result, the photosensitive drum 100 can be operated to be driven when the friction torque is greater than the sum of the acceleration torque, i.e., the first item on the right-hand, and the load torque, i.e., the second item on the right-hand. Basically, $\Delta T_L$ can be assumed to be small enough to be negligible, so that a driven operability can be improved by increasing the friction torque or reducing the acceleration torque according to equation (3), other than adjusting the assist torque.

Since the friction torque is closely related to a toner transfer process in the primary transfer, it is difficult to change the friction torque. On the other hand, the acceleration torque can be easily reduced by decreasing the drum inertia.

The inertia component of the drum BLDC motor 30 with respect to the drum shaft 50 is greatly affected by a gear ratio between the drum reduction gear 51 and the drum motor shaft gear 32. The inertia component is obtained by multiplying the inertia component of the motor shaft by a square of the gear ratio.

As a result, the inertia component of the drum BLDC motor 30 with respect to the drum shaft 50 may become extremely larger than the inertia component of the photosensitive drum 100. According to the present exemplary embodiment, a BLDC motor of low inertia type, i.e., inner rotor type, is thus used as the drum BLDC motor 30.

As described above, the ITB 108 can operate the photosensitive drum 100 to be driven using the friction torque by performing the following. The assist torque is added to cancel the constant component of the load torque in the photosensitive drum shaft, and a motor of low inertia component is selected.

According to the present exemplary embodiment, the drum BLDC motor 30 is the assist torque generation source. However, it is not limited thereto as long as constant torque can be generated.

The friction torque and the driven operation of the photosensitive drum 100 are described above using the equations of motion. However, there is a problem in obtaining the assist torque from the equations (1), (2), and (3). More specifically, the assist torque is equivalent to the load torque, so that the assist torque may be obtained by measuring the load torque. However, a measuring state is different from an actual state of performing printing, so that an error occurs in the measurement.

In other words, the load torque is generated in the state where the photosensitive drum 100 is driven so that the surface speed thereof becomes the same as that of the ITB 108. The actual print operation is performed by the photosensitive drum 100 and the ITB 108 in contact with each other. However, it is necessary to perform measurement when the photosensitive drum 100 and the ITB 108 are separated to distinguish the load torque and the friction torque.

In such a case, if there is a constant difference between the surface speeds of the photosensitive drum 100 and the ITB 108, the friction torque is constantly generated when the photosensitive drum 100 and the ITB 108 are in contact in performing printing. The driven operation then becomes easily cancelled, which will be described in detail below.

To solve such a problem, the torque instruction value for generating the appropriate assist torque for realizing steady driven operation control is set as follows. The torque instruction value is included within the range (hereinafter referred to as a driven operation region) between the torque instruction values corresponding to the maximum static friction torque with respect to various torque fluctuations 581 of the photosensitive drum 100.

Figure 10A:
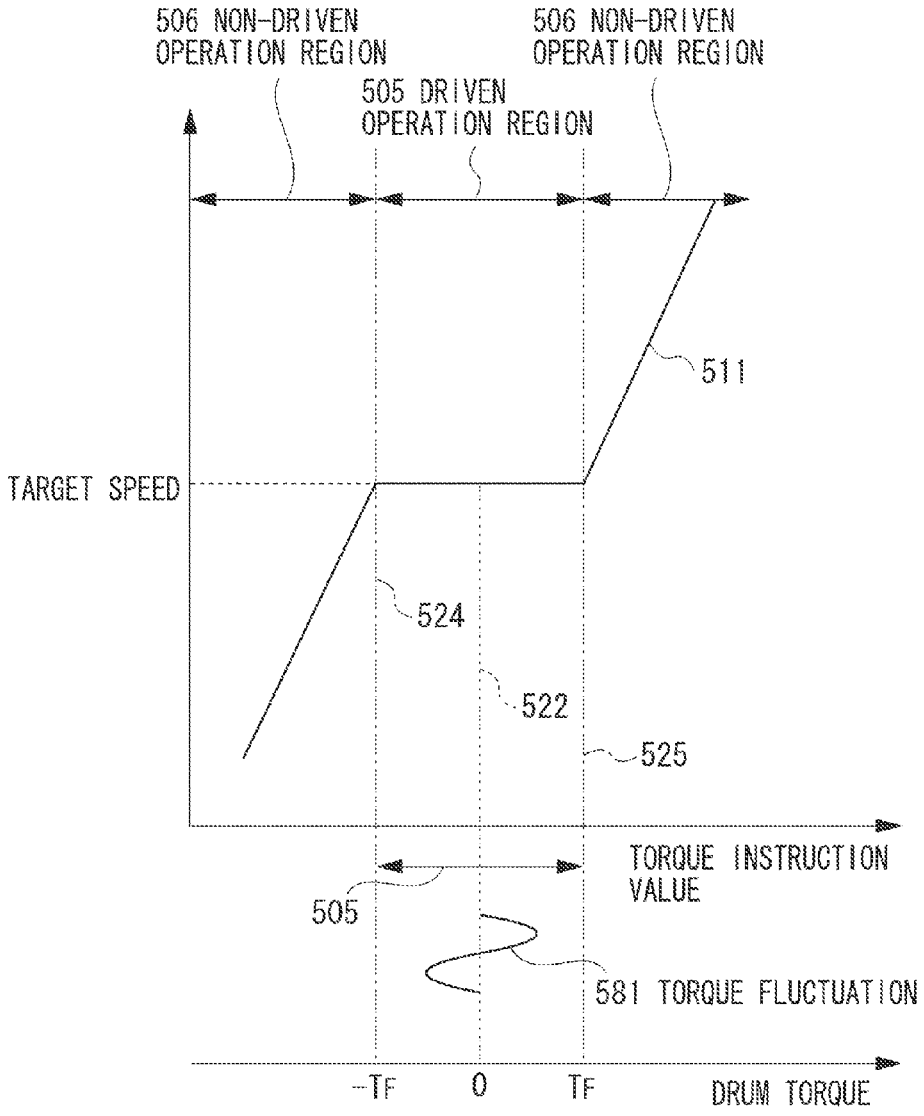
FIGS. 10A, 10B, and 10C illustrate relations between the torque instruction value and the surface speed of the photosensitive drum.
Figure 10B:
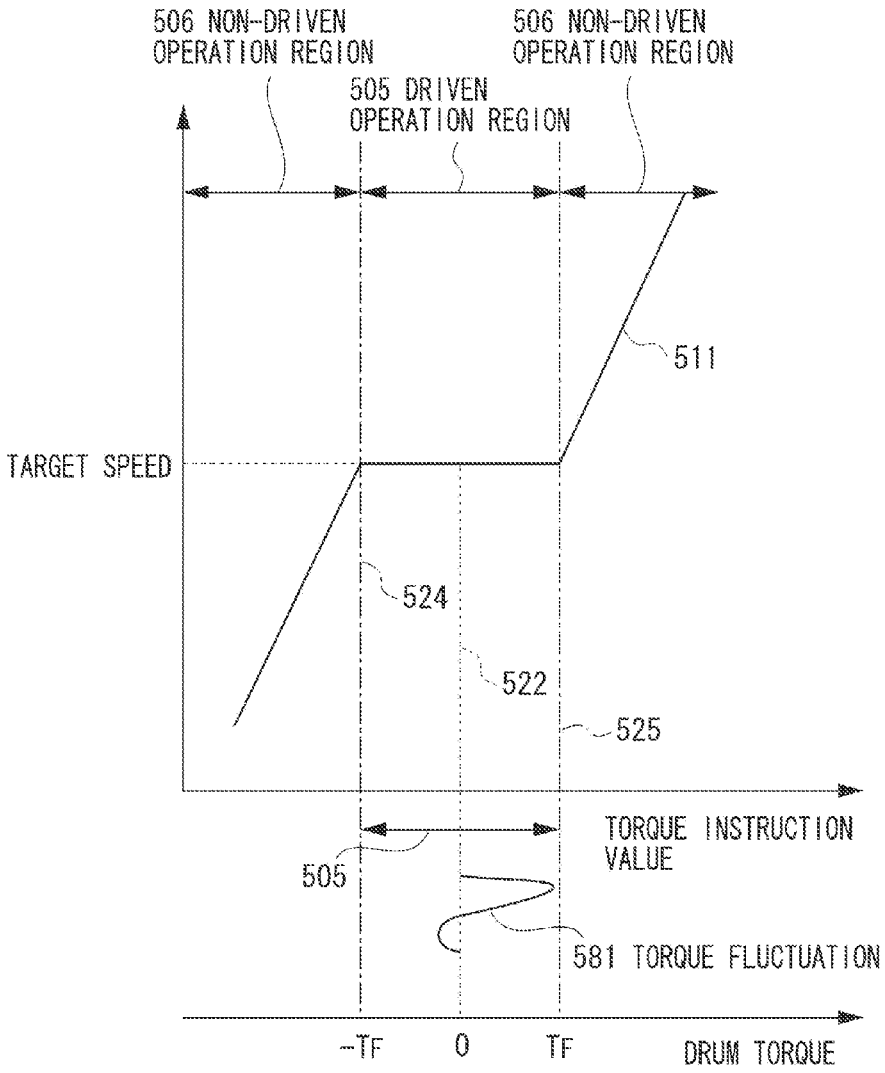
Figure 10C:
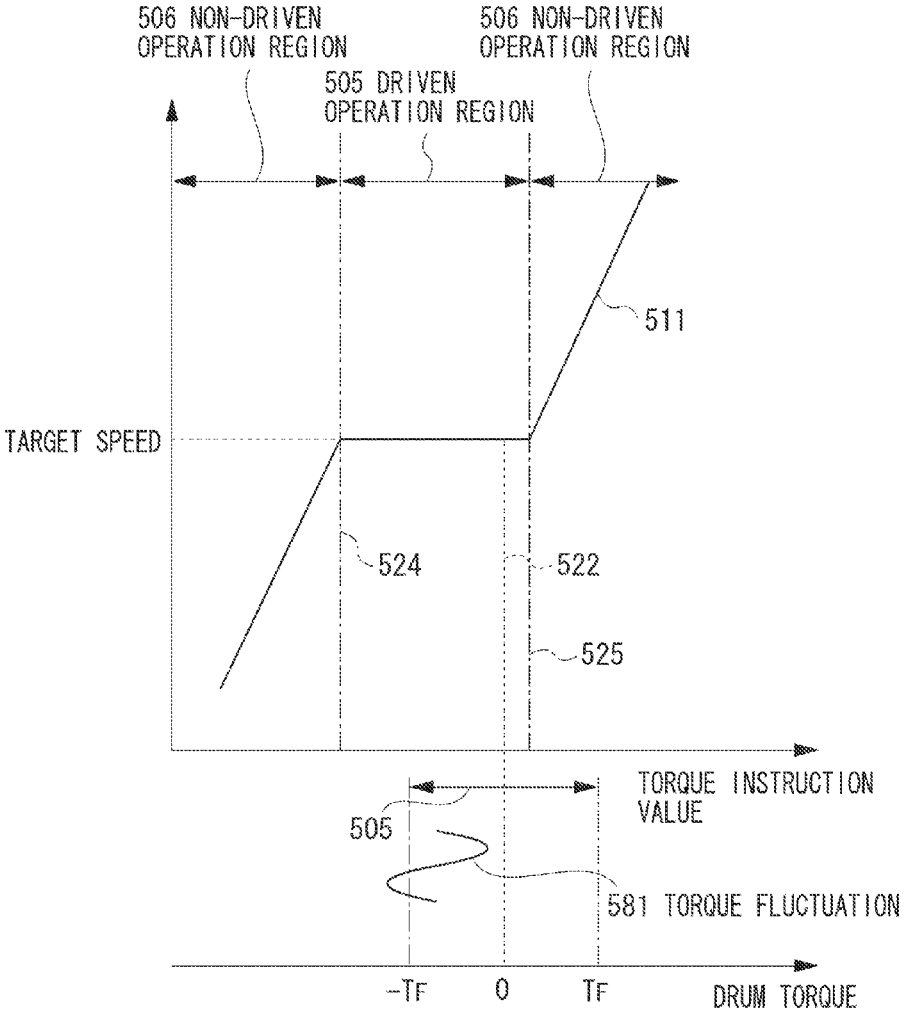

FIGS. 10A, 10B, and 10C illustrate the relations between the torque instruction value and the photosensitive drum surface speed.

Referring to FIGS. 10A, 10B, and 10C, the photosensitive drum surface speed is indicated on the vertical axis, and the torque instruction value is indicated on the horizontal axis. The graphs are made by plotting an average value of a surface speed 511 obtained by applying the torque instruction value for generating the assist torque before each printing.

Further, FIGS. 10A, 10B, and 10C illustrate the state of the torque around the photosensitive drum 100. The examples illustrated in FIGS. 10A, 10B, and 10C indicate the position at which the torque around the photosensitive drum 100 becomes 0 with respect to the position of the obtained assist torque amount.

Normally, if the torque instruction value applied to the photosensitive drum 100 is increased, the surface speed 511 also increases. However, there is a region in which there is no change in the surface speed 511 even when the torque instruction value is increased. Such an area is a driven operation region 505.

Further, a minimum torque instruction value 524 and a maximum torque instruction value 525 in the driven operation region 505 correspond to the above-described maximum static friction torques. Furthermore, a torque instruction value 522 is a point which divides the maximum static friction torques into a positive value and a negative value, i.e., the point in which the friction torque becomes 0.

In other words, the size of the friction torque increases towards the torque instruction values 524 and 525 from the torque instruction value 522 at the center where the friction torque is 0. Further, if the torque instruction value exceeds the torque instruction values 524 and 525 and thus the driven operation region 505, the torque instruction value enters a non-driven operation region 506. In such a case, the friction coefficient becomes a dynamic friction coefficient, and the friction torque decreases.

As a result, the median between the torque instruction value 524 and the torque instruction value 525 at which the surface speed of the photosensitive drum 100 starts to change with respect to the torque instruction value is the optimal assist torque. However, there may be a case where the average value of the torque fluctuation is not 0 as illustrated in FIG. 10B, so that the median is not necessarily the optimal assist torque. If the assist torque cannot be appropriately obtained, the state becomes as illustrated in FIG. 10C.

There is a case where the result of deriving the assist torque from the above-described equations of motion does not become the median. In the worst case, the result may become close to outside the driven operation region 505 when the torque instruction value 525 corresponding to the measured assist torque is within the driven operation region.

Further, the torque fluctuation may become greater than expected due to the effect of the high pressure applied in the primary transfer process which does not appear when performing measurement in the separated state. The torque instruction value may then become outside of the driven operation region 505. As a result, it may appear as speed fluctuation in the surface speed of the photosensitive drum 100, and color misregistration and banding may become noticeable. The above-described method for deriving the assist torque applies to a case where the average value of the torque fluctuation is 0.

Furthermore, the state of the driven operation changes with time when the image forming apparatus is performing printing, so that it becomes necessary to correct the assist torque while the image forming process is being performed.

As illustrated in FIG. 6, the assist torque is the rotation torque for cancelling the load torque generated by the cleaner blade 104 and the drum shaft bearing in the rotation operation during the image forming process.

The load torque generated by the cleaner blade 104 and the drum shaft bearing changes along with time during the print process, due to the change in an amount of applied toner and time degradation of the cleaner blade 104.

Figure 11:
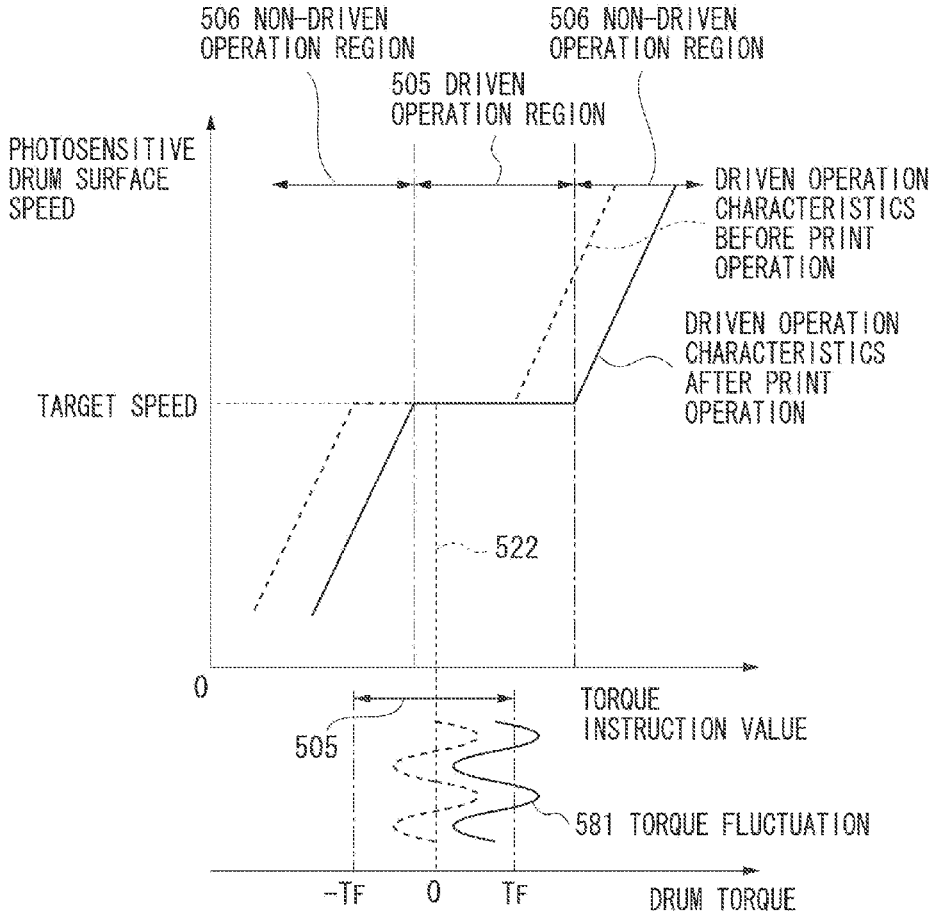
FIG. 11 illustrates the relation between the torque instruction value and the surface speed of the photosensitive drum, and the torque fluctuation.

FIG. 11 illustrates the relation between the torque instruction value and the photosensitive drum surface speed, and the torque fluctuation.

Referring to FIG. 11, the photosensitive drum surface speed is indicated on the vertical axis, and the torque instruction value is indicated on the horizontal axis. The graph of FIG. 11 illustrates the change in the torque instruction value and the average value of the photosensitive drum surface speed before and after performing printing. Further, the torque fluctuation 581 indicates the change in the torque (i.e., a change in the DC component) during the process of printing.

The torque fluctuation 581 is obtained by adding the acceleration torque of the ITB 108 and the load torque of the photosensitive drum 100, and subtracting the assist torque. The torque fluctuation changes similarly as the direct current by the change in the DC component of the load torque.

The DC component of the torque fluctuation 581 changes during the process of printing. If the torque instruction value 522 set before performing printing using the above-described method for deriving the assist torque is then fixed, the DC change amount in the torque fluctuation 581 cannot be cancelled.

As a result, if the torque fluctuation 581 becomes greater than or close to the friction torque generated by the contact surfaces between the photosensitive drum 100 and the ITB 108, the driven operation of the photosensitive drum 100 and the ITB 108 cannot be continued.

In such a case, it becomes necessary to correct the assist torque each time the print operation is performed. However, time is required for measuring the assist torque when deriving the assist torque as described above in the case where an appropriate value of the assist torque is unknown.

More specifically, the torque instruction value for generating the assist torque is output to a photosensitive drum drive source at each discrete sample point positioned at predetermined distances. The average value of the surface speed 511 of the photosensitive drum 100 in each case is then measured, so that it becomes necessary to select the assist torque from a wide range.

A change in the surrounding environment of the photosensitive drum 100 is small within a short period of time, such as during the print operation, and the amount of the load torque changes along with time. The subsequent assist torque can thus be obtained using the previously measured assist torque. The time necessary for deriving the assist torque can be shortened by performing such a method.

Hereinafter, the above-described assist torque derivation method will be referred to as an initial assist torque derivation method, and the assist torque derivation method to be described below will be referred to as an assist torque correction method.

In the graph illustrated in FIG. 11, the change in the torque 581 is caused by the change in the DC component of the load torque when the print operation is performed. If the torque fluctuation 581 is included in the range of the maximum friction torque, the driven operation state can be maintained. However, the torque changes with time when the print operation is performed.

A rapid change in the torque is likely to cancel the driven operation state, so that it is desirable to calculate the assist torque by considering the torque fluctuation generated in such a case. The maximum fluctuation of the torque fluctuation 581 when the print operation is performed is thus previously estimated. Amplitude and frequency of a pseudo AC component of torque fluctuation acceleration are then set to obtain the estimated torque fluctuation acceleration, so that alternating current (AC) sine wave torque is generated.

In such a case, a margin of $+\alpha$ may be applied to the maximum torque fluctuation acceleration, assuming that the torque fluctuation 581 becomes greater than the estimated maximum torque fluctuation acceleration when the print operation is performed. Further, a maximum static friction torque amount calculated in each case may be used as an index of the AC sine wave torque instead of previously measuring the torque fluctuation 581.

The photosensitive drum 100 is then driven by superimposing the obtained sine wave torque on the DC component of the assist torque to be applied thereto. The drum surface speed is measured at each predetermined sampling time, and the maximum speed and the minimum speed within a predetermined period are measured. Vhi (i.e., maximum speed−target speed) and Vlow (i.e., target speed−minimum speed) are then obtained based on the target speed of the photosensitive drum. In other words, the values of Vhi and Vlow are the resulting photosensitive drum surface speed fluctuation caused by superimposing the AC sine wave torque on the original DC component of the assist torque.

The assist torque is derived as follows. The range of the driven operation region 505 in which the current torque instruction value is included is determined based on whether the values of Vhi and Vlow are included in a predetermined range. If the torque instruction value 522 is outside or close to outside the driven region 505, the speed increases and decreases with respect to the target value by only the amount of torque which has become outside of the driven region. As a result, Vhi becomes greater than a predetermined amount, or Vlow becomes greater than the predetermined amount.

Since a fluctuation range of the torque fluctuation 581 is small as compared to the driven operation region 505, Vhi and Vlow do not both become greater than the predetermined amount at the same time. Upon determining the position of the assist torque within the driven region 505, the torque instruction value 525, i.e., the maximum value within the driven region, is thus obtained, and the torque instruction value 524, i.e., the minimum value within the driven region, is subsequently obtained. A median between the torque instruction values 524 and 525 is then set as the optimal assist torque.

An algorithm for performing the above-described method is as follows. If Vhi is greater than a predetermined amount, the torque instruction value is decremented by predetermined amounts. The torque instruction value when Vhi has become less than or equal to the predetermined amount is then stored as Thi.

On the other hand, if Vhi is less than or equal to the predetermined amount, the torque instruction value is incremented by predetermined amounts. The torque instruction value when Vhi has become greater than the predetermined amount is then stored as Thi.

Further, the torque instruction value is decremented by predetermined amounts, and an assist torque setting value when Vlow has become greater than the predetermined amount is stored as Tlow. The median between Thi and Tlow becomes the optimal assist torque setting value.

The above-described algorithm is the method for correcting the assist torque each time the print operation is performed. The assist torque obtained by performing the initial assist torque derivation method initially drives the photosensitive drum 100. However, it is not limited thereto, and if the load torque is expected as a predetermined value, such a predetermined value may be used as the assist torque. Further, the assist torque obtained by the previous assist torque correction method may be used between the print operations.

Figure 12:
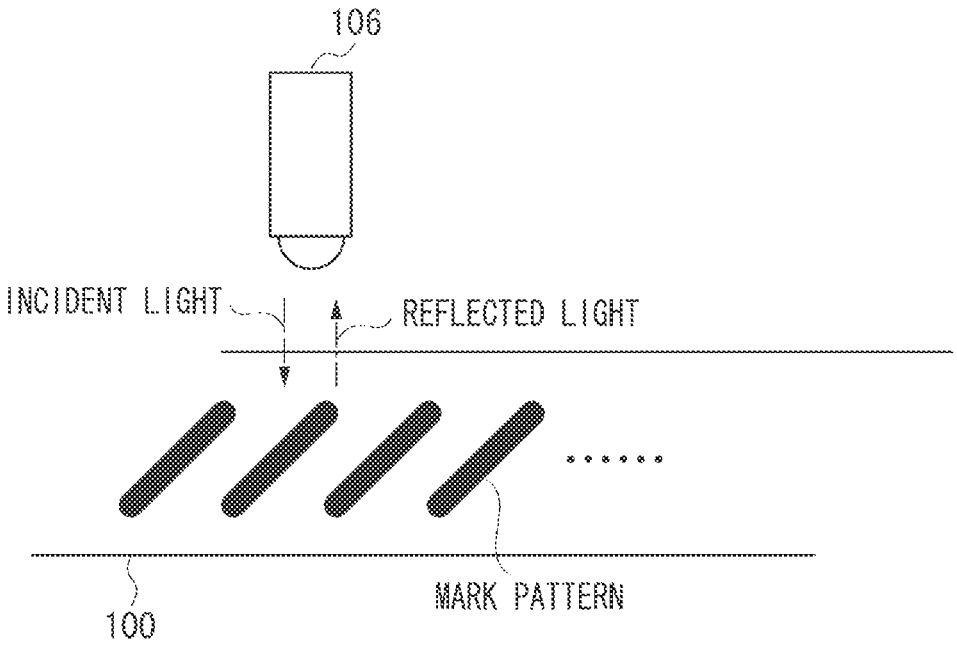
FIG. 12 illustrates a method for detecting a surface position of the photosensitive drum.

FIG. 12 illustrates a method for detecting the surface position on the photosensitive drum 100.

A reflection type photoelectric sensor used as the surface position detection unit 106 performs surface position detection on the photosensitive drum 100.

Referring to FIG. 12, mark patterns are previously drawn at equal distances on the surface of the photosensitive drum 100. The mark patterns are not drawn on an image forming region of the photosensitive drum 100.

The reflection type photoelectric sensor detects reflection of incident light and thus detects the mark patterns. As a result, a sensor output is switched between a position where there is a mark and a position where there is no mark. Further, by setting a threshold value on the appropriate voltage, an output waveform becomes a rectangular wave. The surface position on the photosensitive drum 100 can then be identified by previously determining a reference position and counting the number of rectangular waves from the reference position. The surface position is identified at the accuracy according to a resolution of the mark patterns on the photosensitive drum 100.

The ASIC 60 illustrated in FIG. 5 controls the timing of the exposure signal for drawing a print image. Exposure control can thus be performed in accordance with the surface position of the photosensitive drum 100 by inputting the surface position detection signal to the ASIC 60. The electrostatic latent image can then be drawn on the photosensitive drum 100 without position displacement.

In general, when a main power source of the image forming apparatus is switched on, the image forming apparatus initially enters an adjustment mode. In the adjustment mode, the image forming apparatus performs temperature adjustment of the fixing roller in the fixing unit 113, main scan tilt correction, and correction between colors. Upon completion of the adjustment mode, the image forming apparatus can then start the print operation.

According to the present exemplary embodiment, the process for deriving the assist torque is included in the adjustment mode. Further, as described above, the driven operation state also changes when the print operation is performed, so that it is necessary to correct the assist torque when the print operation is performed. A general image forming apparatus performs processing at a plurality of processing speeds for printing on cardboard paper and other types of paper, so that the assist torque is required to be derived for each process speed.

The assist torque is derived by performing the print process similarly as the print operation, and measuring the surface speed of the photosensitive drum 100. In such a case, the drum rotary encoder 40 detects the surface speed.

The photosensitive drum 100 is rotationally driven by supplying the current to the drum BLDC motor 30. The drum motor driver IC 24 is a driver IC which determines the phase current to be supplied to the drum BLDC motor 30 according to the PWM signal.

As described above, the duty ratio of the PWM signal determines the size of the torque generated in the drum BLDC motor 30. It is thus necessary to adjust the duty ratio so that the assist torque to be generated in the print process is large enough for the surface speed of the photosensitive drum 100 to become the target process speed.

Figure 13:
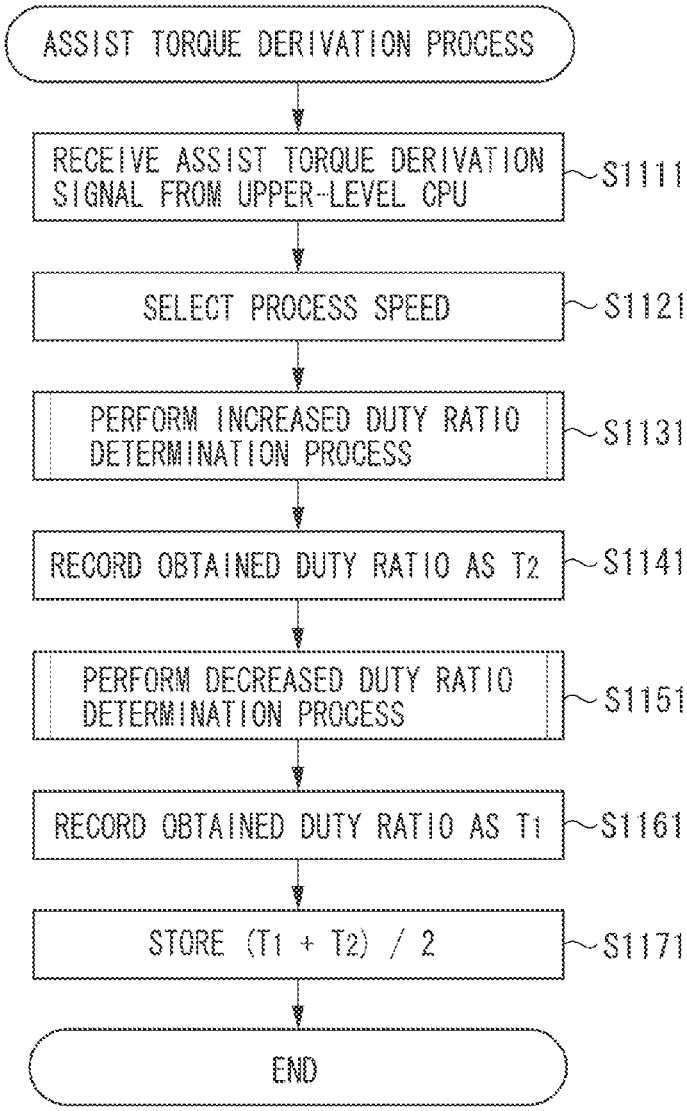
FIG. 13 is a flowchart illustrating an assist torque derivation process performed by a central processing unit (CPU).

FIG. 13 is a flowchart illustrating the assist torque derivation process performed by the CPU 210.

Referring to FIG. 13, in step S1111, the CPU 210 receives from the upper-level CPU 10 an assist torque derivation start signal. In step S1121, the CPU 210 selects the process speed. As described above, since there is a plurality of process speeds, the CPU 210 selects one from the plurality of process speeds.

In step S1131, the CPU 210 performs an increased duty ratio determination process. More specifically, the CPU 210 measures the average value of the photosensitive drum surface speed when the duty ratio has been increased, and determines the duty ratio. In step S1141, the CPU 210 then records in the RAM 23 as $T_2$ the duty ratio determined in the increased duty ratio determination process.

In step S1151, the CPU 210 similarly performs a decreased duty ratio determination process, i.e., measures the average value of the photosensitive drum surface speed when the duty ratio has been decreased, and determines the duty ratio. In step S1161, the CPU 210 then records in the RAM 23 as $T_1$ the duty ratio determined in the decreased duty ratio determination process.

In step S1171, the CPU 210 records $(T_1+T_2)/2$ in the RAM 23, and the process ends. The CPU 210 performs the above-described processes from step S1121 to step S1171 for all process speeds. As a result, the CPU 210 obtains $(T_1+T_2)/2$ corresponding to each of the process speeds.

Further, as described above, the average value of the torque fluctuation during image formation is the optimal assist torque, and is not necessarily the median of the torque fluctuation. The assist torque may thus be obtained as $(\alpha T_1+T_2)/2$ or $(T_1+\alpha T_2)/2$ by multiplying the duty ratio $T_1$ or $T_2$ by a positive weight coefficient $\alpha$.

Figure 14:
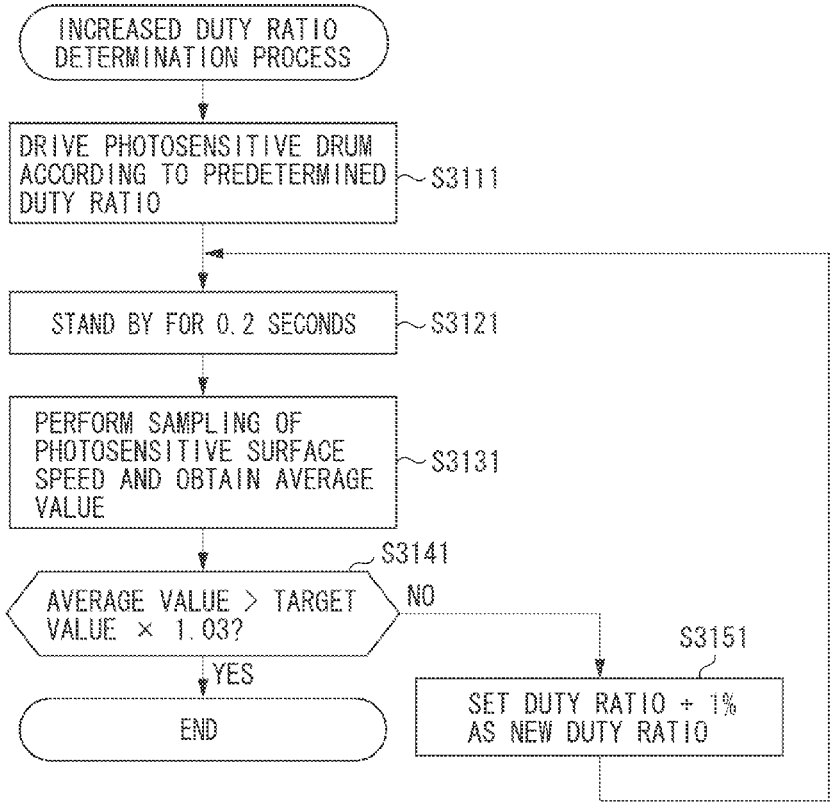
FIG. 14 is a flowchart illustrating an increased duty ratio determination process illustrated in the flowchart of FIG. 14.

FIG. 14 is a flowchart illustrating the increased duty ratio determination process performed in the flowchart illustrated in FIG. 13.

In step S3111, the CPU 210 inputs the predetermined duty ratio to the drum motor driver IC 24, drives the drum BLDC motor 30, and thus drives the photosensitive drum 100. In such a case, speed control is performed so that the surface speed of the ITB 108 becomes the set process speed, and such a state is maintained while the assist torque is being derived. Further, if the preset duty ratio is not stored in the RAM 23, the preset duty ratio is obtained from the ROM 220.

In step S3121, the CPU 210 stands by for a predetermined period (e.g., 0.2 seconds) until the surface speed of the photosensitive drum 100 stabilizes. In step S3131, the CPU 210 performs sampling of the photosensitive drum surface speed and obtains the average value. More specifically, the CPU 210 performs sampling of the photosensitive drum surface speed 10 times at a predetermined interval (e.g., 10 milliseconds), and obtains the average value.

In step S3141, the CPU 210 determines whether the average value of the photosensitive drum surface speed has exceeded the target value×1.03. The value 1.03 is an example, and may be determined as appropriate based on various experiments. Further, the target speed may be the average value of the actual surface speed of the ITB 108.

If the CPU 210 determines that the average value of the photosensitive drum surface speed is less than or equal to the target value×1.03 (NO in step S3141), the process proceeds to step S3151. In step S3151, the CPU 210 sets as the new duty ratio, the sum of the current duty ratio and 1%. The process then returns to step S3121. In other words, the CPU 210 increases the duty ratio and again performs sampling.

On the other hand, if the CPU 210 determines that the average value of the photosensitive drum surface speed has exceeded the target value×1.03 (YES in step S3141), the process ends. As described above, the CPU 210 stores as $T_2$, the duty ratio determined by performing the process.

Figure 15:
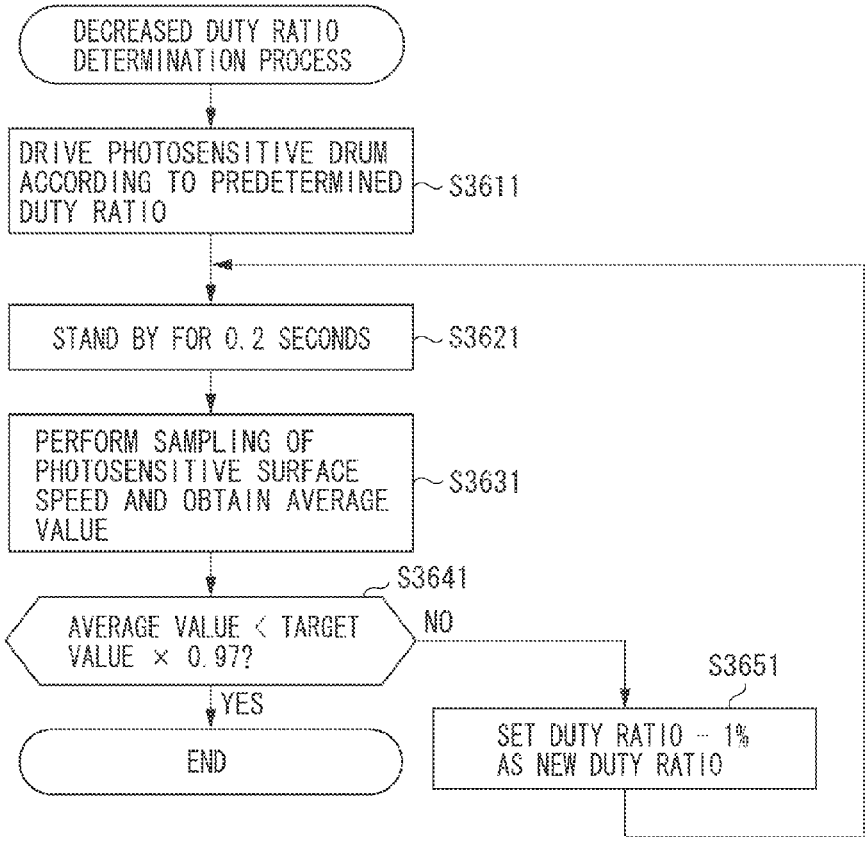
FIG. 15 is a flowchart illustrating a decreased duty ratio determination process illustrated in the flowchart of FIG. 14.

FIG. 15 is a flowchart illustrating the decreased duty ratio determination process performed in the flowchart illustrated in FIG. 13.

Referring to FIG. 15, in step S3611, the CPU 210 inputs the predetermined duty ratio to the drum motor driver IC 24, drives the drum BLDC motor 30, and thus drives the photosensitive drum 100. In such a case, speed control is performed so that the surface speed of the ITB 108 becomes the set process speed, and such a state is maintained while the assist torque is being derived. Further, if the preset duty ratio is not stored in the RAM 23, the preset duty ratio is obtained from the ROM 220.

In step S3621, the CPU 210 stands by for a predetermined period (e.g., 0.2 seconds) until the surface speed of the photosensitive drum 100 stabilizes. In step S3631, the CPU 210 performs sampling of the photosensitive drum surface speed and obtains the average value. More specifically, the CPU 210 performs sampling of the photosensitive drum surface speed 10 times at a predetermined interval (e.g., 10 milliseconds), and obtains the average value.

In step S3641, the CPU 210 determines whether the average value of the photosensitive drum surface speed is less than the target value×0.97. The value 0.97 is an example, and may be determined as appropriate based on various experiments. Further, the target speed may be the average value of the actual surface speed of the ITB 108.

If the CPU 210 determines that the average value of the photosensitive drum surface speed is greater than or equal to the target value×0.97 (NO in step S3641), the process proceeds to step S3651. In step S3651, the CPU 210 sets as the new duty ratio, the difference between the current duty ratio and 1%. The process then returns to step S3621. In other words, the CPU 210 decreases the duty ratio and again performs sampling.

On the other hand, if the CPU 210 determines that the average value of the photosensitive drum surface speed is less than the target value×0.97 (YES in step S3641), the process ends. As described above, the CPU 210 stores as $T_1$, the duty ratio determined by performing the process.

Figure 16A:
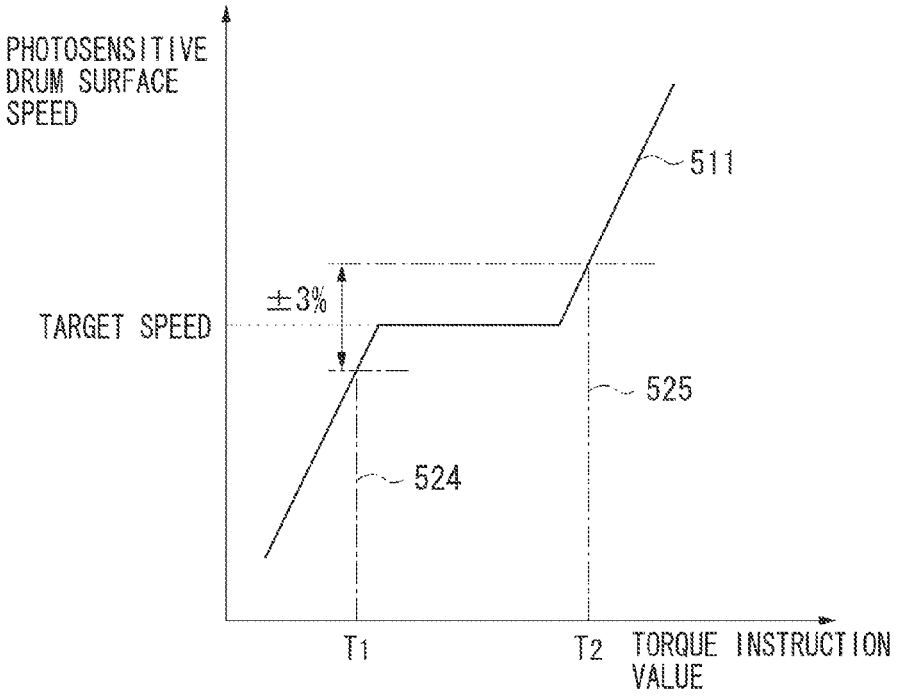
FIGS. 16A and 16B illustrate the torque obtained by performing the assist torque deviation process illustrated in FIG. 13.
Figure 16B:
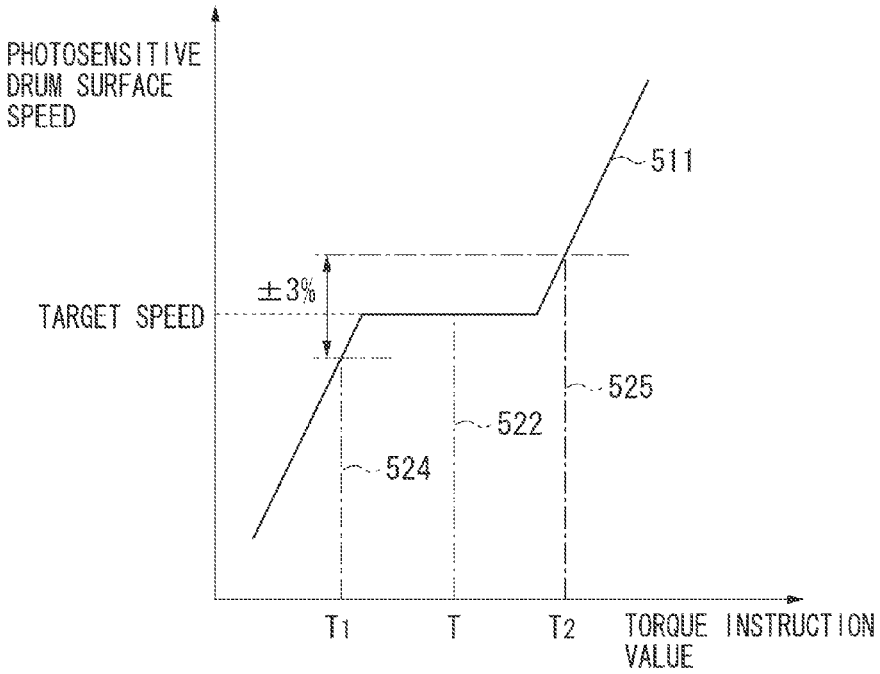

FIGS. 16A and 16B illustrate the torque instruction values obtained by performing the assist torque derivation process illustrated in FIG. 13.

Referring to FIGS. 16A and 16B, the photosensitive drum surface speed is indicated on the vertical axis, and the torque instruction value on the horizontal axis.

FIG. 16A illustrates $T_1$ and $T_2$ obtained by performing the increased duty ratio determination process and the decreased duty ratio determination process. More specifically, FIG. 16A indicates the torque instruction values when the average value of the photosensitive drum surface speed is ±3% of the target speed as in the above-described example.

FIG. 16B indicates $(T_1+T_2)/2$ (=T) stored in the RAM 23 in step S1171.

In the above-described assist torque correction method, the print process is similarly performed as when deriving the assist torque each time the print operation is performed. The surface speed of the photosensitive drum 100 is then measured, and the AC fluctuation component is applied to the assist torque obtained from the measured value.

As described above, if the assist torque in not included in the drive operation region 505 or becomes close to the torque instruction value 525, i.e., the maximum value in the drive operation region, speed fluctuation corresponding to the amount which is outside the drive operation region is generated. The assist torque is thus corrected by measuring the amount of the speed fluctuation.

Figure 17:
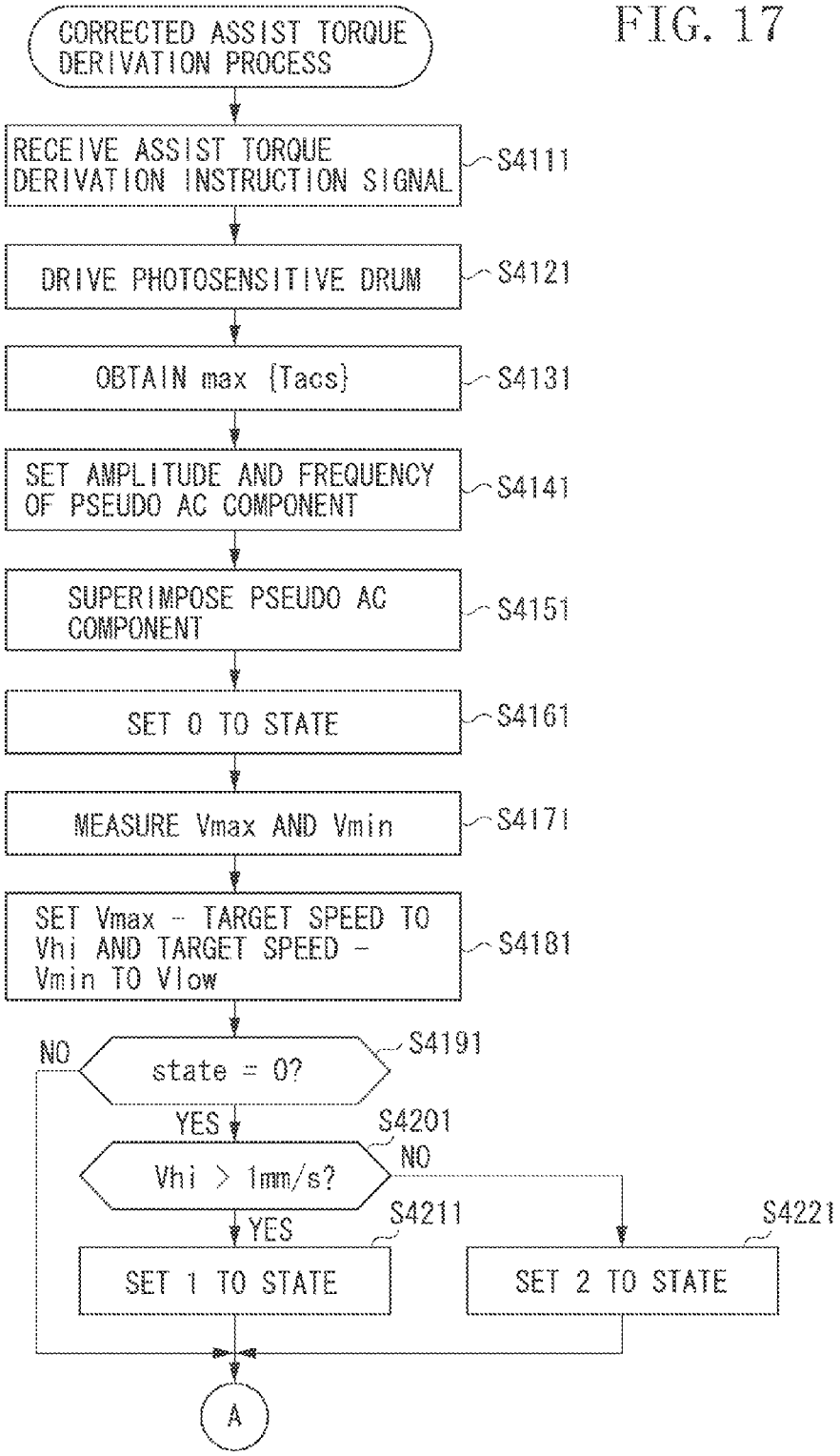
FIG. 17 is a flowchart illustrating a corrected assist torque correction process performed by the CPU illustrated in FIG. 4.
Figure 18:
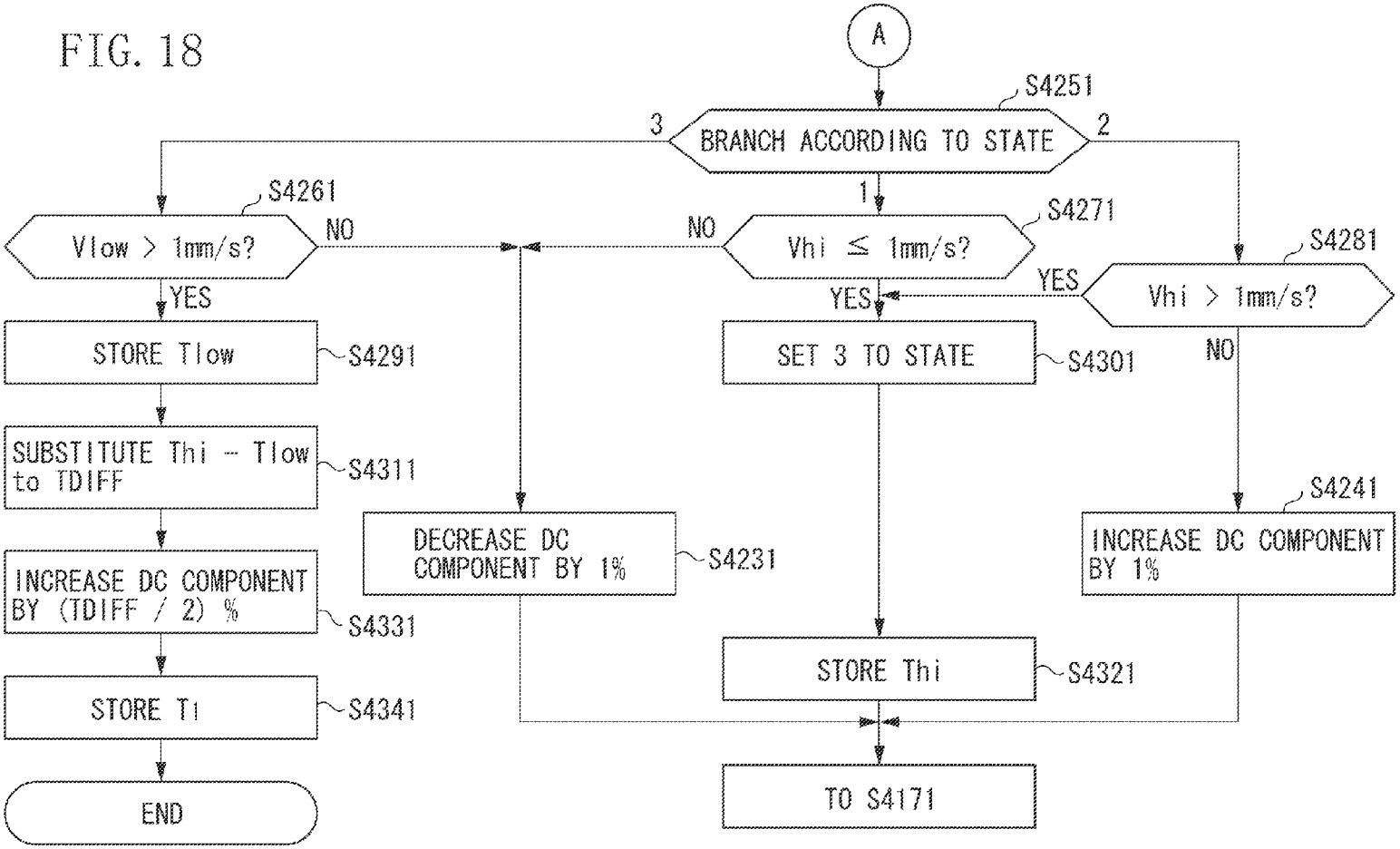
FIG. 18 is a flowchart illustrating a corrected assist torque correction process performed by the CPU illustrated in FIG. 4.

FIGS. 17 and 18 are flowcharts illustrating the corrected assist torque derivation process performed by the CPU 210 illustrated in FIG. 4.

The corrected assist torque derivation method illustrates the concrete procedures of the above-described assist torque correction method. The corrected assist torque process is performed as follows. The CPU 210 determines where the current torque instruction value is set in the range of the drive operation region 505. There are cases where the torque instruction value is within or outside of the driven operation region 505, and the torque instruction value 525, i.e., the maximum value in the driven operation region, is determined for both cases. The torque instruction value 524, i.e., the minimum value in the driven operation region, is then determined. The median between the torque instruction values 524 and 525 becomes the optimal assist torque value.

In step S4111 illustrated in FIG. 17, the CPU 210 receives from the upper-level CPU 10 an assist torque derivation instruction signal for deriving the duty ratio for generating the assist torque. In step S4121, the CPU 210 inputs to the drum motor driver IC 24 the duty ratio obtained by the assist torque derivation process, stored in the RAM 23. The CPU 210 thus drives the BLDC motor 30 and the photosensitive drum 100.

In step S4131, the CPU 210 obtains from the ROM 220, torque fluctuation acceleration max {Tacs} previously determined by estimating the maximum fluctuation of the torque fluctuation 581 when the print operation is performed.

In step S4141, the CPU 210 sets the amplitude and the frequency of the pseudo AC component of the torque fluctuation acceleration so that the torque fluctuation acceleration becomes max {Tacs}. In step S4151, the CPU 210 superimposes, on the DC component of the assist torque to be applied to the photosensitive drum 100, the sine wave torque having the set amplitude and frequency.

In step S4161, the CPU 210 sets a state to 0 and initializes the state. The state is set to one of 0, 1, 2, and 3. 0 indicates that it is not determined where the current torque instruction value is set in the range of the driven operation region 505. 1 and 2 indicate that the torque instruction value 525, i.e., the maximum value in the driven operation region, is to be determined. 3 indicates that the torque instruction value 524, i.e., the minimum value in the driven operation region, is to be determined. Further, in the description below, the torque instruction value is included in the driven operation region 505 in the initial state.

In step S4171, the CPU 210 measures the surface speed of the photosensitive drum 100 at every predetermined sampling time, i.e., 0.1 μs, and measures a maximum speed Vmax and a minimum speed Vmin within a predetermined period, i.e., 10 μs. The process performed in step S4171 corresponds to that of a measuring unit which measures the maximum speed and the minimum speed of the surface of a rotating image bearing member.

In step S4181, the CPU 210 sets Vhi={Vmax−target speed} and Vlow={target speed−Vmin} based on the target speed of the photosensitive drum 100.

In step S4191, the CPU 210 determines whether the state is 0. If the state is not 0 (NO in step S4191), the process proceeds to step S4251 illustrated in FIG. 18.

On the other hand, if the state is 0 (YES in step S4191), the process proceeds to step S4201. In step S4201, the CPU 210 determines whether Vhi>1 mm/s. If Vhi>1 mm/s (YES in step S4201), the process proceeds to step S4211. In step S4211, the CPU 210 sets the state to 1. The process then proceeds to step S4251 illustrated in FIG. 18.

If Vhi is not greater than 1 mm/s (NO in step S4201), the process proceeds to step S4221. In step S4221, the CPU 210 sets the state to 2. The process then proceeds to step S4251 illustrated in FIG. 18.

If the torque instruction value is included in the driven operation region 505 as in the above-described initial state, Vh≤1 mm/s. The process thus branches from step S4201 to step S4221, and the state becomes 2.

In step S4251, the process is branched according to the state. If the state is 2 in step S4251, the process proceeds to step S4281. In step S4281, the CPU 210 determines whether Vhi>1 mm/s. If Vhi is not greater than 1 mm/s (NO in step S4281), the process proceeds to step S4241. In step S4241, the CPU 210 increases the DC component by 1%. The process then returns to step S4171. As described above, when the torque instruction value is included in the drive operation region 505 in the initial state, the DC component is incremented, and the torque instruction value 525, i.e., the maximum value in the driven operation region, is determined.

On the other hand, if Vhi>1 mm/s (YES in step S4281), the process proceed to step S4301. In step S4301, since the torque instruction value 525, i.e., the maximum value in the driven operation region, has been determined, the CPU 210 sets the state to 3.

In step S4321, the CPU 210 stores in the RAM 23 the current torque instruction value as Thi. The process then returns to step S4171.

If the state is 3 in step S4251, the process proceeds to step S4261. In step S4261, the CPU 210 determines whether Vlow>1 mm/s. If Vlow is not greater than 1 mm/s (NO in step S4261), the process proceeds to step S4231. In step S4231, the CPU 210 decreases the DC component by 1%. The process then returns to step S4171. As described above, the DC component is decremented, and the minimum torque instruction value in the driven operation region is determined.

On the other hand, if Vlow>1 mm/s (YES in step S4261), the process proceeds to step S4291. In step S4291, the CPU 210 stores in the RAM 23 the current torque instruction value as Tlow.

In step S4311, the CPU 210 substitutes Thi−Tlow in TDIFF. In step S4331, the CPU 210 increases the DC component by (TDIFF/2) %. In other words, since the median between Thi corresponding to the maximum speed and Tlow corresponding to the minimum speed becomes the optimal assist torque setting value, the CPU 210 performs the process of step S4331. However, there is a case where the torque fluctuation corresponding to the median of is not 0, as illustrated in FIG. 10C, so that the median is not necessarily the optimal assist torque. In such a case, the coefficient for dividing TDIFF is changed and adjusted.

In step S4341, the CPU 210 stores, in the RAM 23, the current torque instruction value as T1, and the process ends.

If the state is 1 in step S4251, the process proceeds to step S4271. In step S4271, the CPU 210 determines whether Vhi≤1 mm/s. If Vhi is greater than 1 mm/s (NO in step S4271), the process proceeds to step S4231.

If Vhi≤1 mm/s (YES in step S4271), the process proceeds to step S4301.

When a print process other than the first print process after the adjustment mode is to be performed, the CPU 210 inputs, to the drum motor driver IC 24 of the photosensitive drum 100, the duty ratio which is the torque instruction value derived by the above-described process. The CPU 210 thus drives the photosensitive drum 100.

As a result of performing the above-described determination processes of step S4261, step S4271, and step S4281, the maximum speed and the minimum speed become included within the range of the target speed ±1, i.e., a predetermined range according to the target speed.

By performing the above-described process, the torque instruction values respectively corresponding to the maximum speed and the minimum speed in the following case are obtained. The intermediate transfer member drive unit is controlled by the control unit so that the maximum speed and the minimum speed are included within the predetermined range according to the target speed of the image bearing member.

The process of step S4341 thus corresponds to the following. The process corresponds to the control unit controlling the intermediate transfer member drive unit using the new torque instruction value $T_1$ determined based on the torque instruction values corresponding to the maximum speed and the minimum speed. By performing such control, the driven operation performed by the image bearing member and the intermediate transfer member can be continued.

Figure 19:
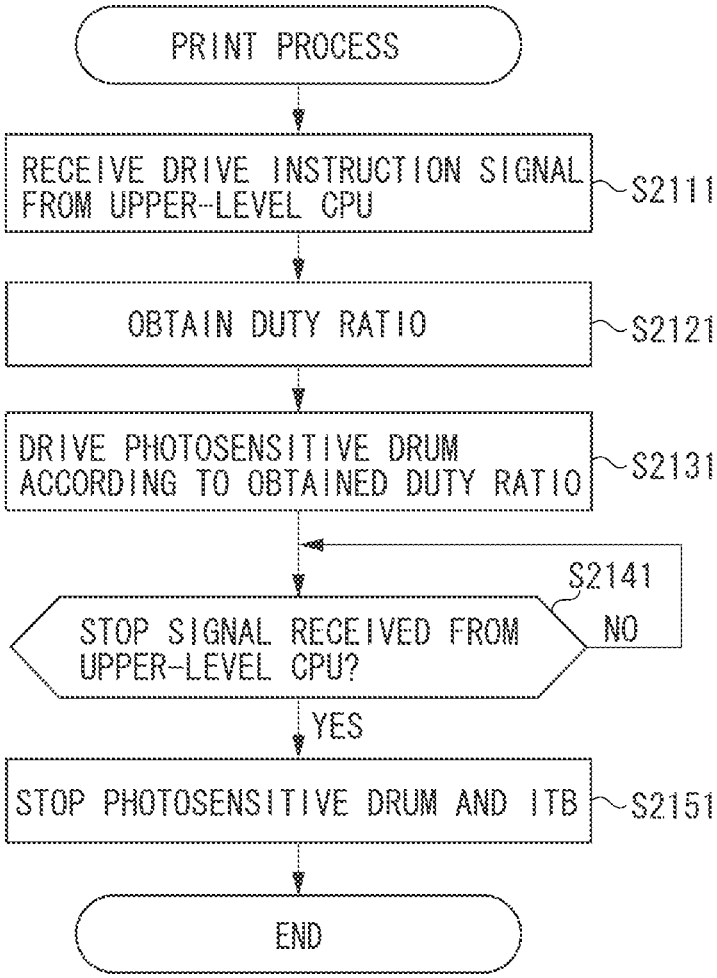
FIG. 19 is a flowchart illustrating a print process performed by the CPU.

FIG. 19 is a flowchart illustrating the print process performed by the CPU 210.

In step S2111, upon the print instruction being input to the upper-level CPU 10 from a user interface or an external personal computer (PC), the CPU 210 receives from the upper-level CPU 10 a drive instruction signal with respect to the photosensitive drum 100 and the ITB 108. The drive instruction signal includes the process speed and a drive-on signal.

In step S2121, the CPU 210 obtains the duty ratio. If the image forming apparatus is in the adjustment mode, the CPU 210 obtains the duty ratio derived in the assist torque derivation process. If the image forming apparatus is performing the print operation, the CPU 210 obtains the duty ratio which is the torque instruction value derived in the corrected assist torque derivation process.

In step S2131, the CPU 210 outputs to the drum motor driver IC 24 the drive-on signal and a fixed PWM signal, and drives the photosensitive drum 100 at the duty ratio obtained in step S2121. In such a case, the ITB 108 is driven by speed feedback control performed by the ITB rotary encoder 41.

In step S2141, the CPU 210 determines whether a stop signal has been received from the upper-level CPU 10. If the CPU 210 determines that the stop signal has been received (YES in step S2141), the process proceeds to step S2151. In step S2181, the CPU 210 stops the photosensitive drum 100 and the ITB 108. The process then ends.

Figure 20:
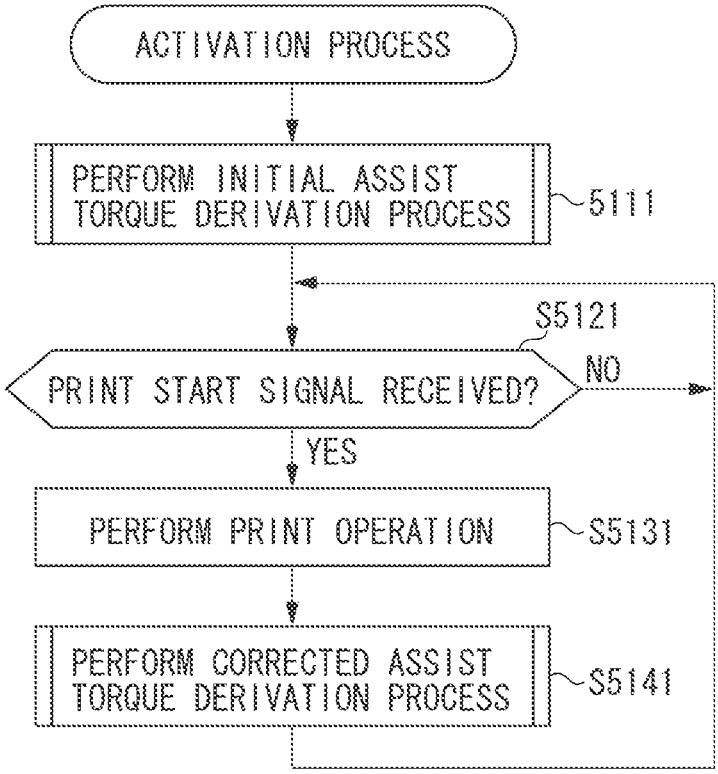
FIG. 20 is a flowchart illustrating an activation process performed by the CPU.

FIG. 20 is a flowchart illustrating an activation process performed by the CPU 210.

In step S5111, the CPU 210 performs the initial assist torque derivation process illustrated in FIG. 13. In step S5121, the CPU 210 determines whether a print start signal has been received from the upper-level CPU 10. If the print start signal has been received (YES in step S5121), the process proceeds to step S5131. In step S5131, the CPU 210 performs the print operation. When the CPU 210 ends the print operation, the CPU 210 stands by to again receive the print start signal. In step S5141, the CPU 210 thus performs the corrected assist torque deviation process illustrated in FIGS. 17 and 18. The process then returns to step S5121.

According to the above-described exemplary embodiment, the image forming apparatus includes four photosensitive drums 100 as illustrated in FIG. 1. However, the present invention is applicable to an image forming apparatus equipped with a single photosensitive drum.

Figure 21:
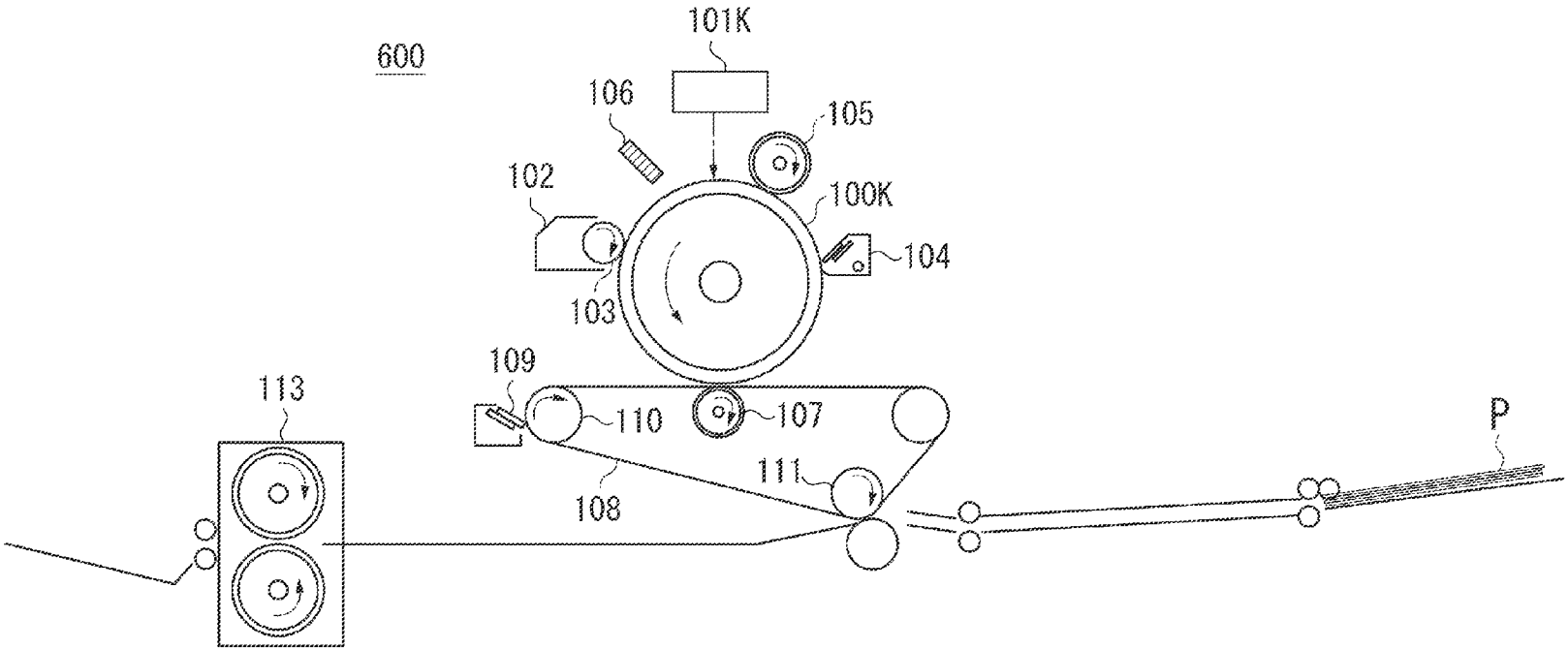
FIG. 21 is a schematic diagram illustrating a configuration of an image forming apparatus quipped with a single photosensitive drum.

FIG. 21 is a schematic diagram illustrating the configuration of an image forming apparatus 600 equipped with a single photosensitive drum.

Referring to FIG. 21, the image forming apparatus 600 is similarly configured as the image forming apparatus 1 illustrated in FIG. 1 except for having a single drum. Further, the drive configurations of a photosensitive drum 100K and the ITB 108 are similar to those illustrated in FIG. 1.

However, the image forming apparatus 600 is different in that the ITB 108 is operated to be driven by the photosensitive drum 100K.

More specifically, the image forming apparatus 600 generates in an ITBBLDC motor 33 the assist torque which cancels the stationary component of the load generated in the ITB drive roller 110. The assist torque is corrected by performing the assist torque process illustrated in FIGS. 17 and 18 with the photosensitive drum 100 and the ITB 108 interchanged.

When the image forming apparatus 600 performs the print operation, the ITB 108 is driven at a predetermined duty ratio by appropriate assist torque. Further, the photosensitive drum 100 is driven by speed feedback control according to the speed detection signal from the drum rotary encoder 40. As a result, the photosensitive drum 100 is operated to be driven by the ITB 108.

The ITBBLDC motor 33, the ITB drive circuit 27, and the ITB motor driver IC 26 illustrated in FIG. 3 thus correspond to an intermediate transfer member drive unit which drives the ITB 108 by generating the assist torque for performing a driven operation of the ITB 108. Further, the controller 20 corresponds to a control unit which outputs the torque instruction value to the intermediate transfer member drive unit and controlling the torque generated by the intermediate transfer member drive unit.

The above-described method for driving the image forming apparatus 600 can be realized when there is a single photosensitive drum.

According to the above-described exemplary embodiment, the driven operation state of the photosensitive drum 100 and the ITB 108 is determined and corrected, so that the surface speeds of the photosensitive drum 100 and the ITB 108 become constantly the same. The driven operation can thus be continued. As a result, the image failures such as color misregistration and banding can be prevented by combining the driven operation with the exposure process performed in synchronization with the surface position.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-275679 filed Dec. 18, 2012, which is hereby incorporated by reference herein in its entirety.

What is claimed is:

1. An image forming apparatus comprising:

an image bearing member configured to be rotatable and to allow a toner image to be formed on a surface thereof;

an intermediate transfer member configured to rotate the image bearing member by contacting and operating the image bearing member to be driven, and to receive the toner image transferred from the image bearing member;

an image bearing member drive unit configured to drive the image bearing member by generating an assist torque for operating the image bearing member to be driven;

a control unit configured to output a torque instruction value to the image bearing member drive unit to control the assist torque generated by the image bearing member drive unit; and a measurement unit configured to measure a maximum speed and a minimum speed of the surface of the image bearing member rotating, wherein the control unit controls the image bearing member drive unit using a new torque instruction value determined based on torque instruction values respectively corresponding to a maximum speed and a minimum speed when controlling the image bearing member drive unit so that the maximum speed and the minimum speed measured by the measurement unit are included in a range which is predetermined according to a target speed of the image bearing member.

2. The image forming apparatus according to claim 1, wherein the new torque instruction value is a median of the torque instruction value corresponding to the maximum speed and the torque instruction value corresponding to the minimum speed.

3. The image forming apparatus according to claim 1, wherein the control unit calculates the new torque instruction value when the image forming apparatus is activated.

4. The image forming apparatus according to claim 1, further comprising a speed detection unit configured to detect a rotation speed of the image bearing member.

5. The image forming apparatus according to claim 4, wherein the speed detection unit is a rotary encoder mounted on a rotational shaft of the image bearing member.

6. The image forming apparatus according to claim 4, wherein the control unit controls, based on a result of detection by the speed detection unit, the rotation speed of the image bearing member.

7. The image forming apparatus according to claim 1, further comprising an exposure unit configured to form an electrostatic latent image on a charged surface of the image bearing member by exposing the image bearing member.

8. The image forming apparatus according to claim 7, further comprising a position detection unit configured to detect a surface position of the image bearing member rotating.

9. The image forming apparatus according to claim 8, wherein the exposure unit exposes the image bearing member in synchronization with the surface position of the image bearing member based on a result of detection by the position detection unit.

10. The image forming apparatus according to claim 7, further comprising:

a developing unit configured to develop the electrostatic latent image on the image bearing member using toner;

a first transfer unit configured to transfer to the intermediate transfer member a toner image developed by the developing unit; and a second transfer unit configured to transfer to recording paper the toner image transferred to the intermediate transfer member by the first transfer unit.

11. An image forming apparatus comprising:

an image bearing member configured to be rotatable and to allow a toner image to be formed on a surface thereof;

an intermediate transfer member configured to contact the image bearing member and to be driven by rotation of the image bearing member, and configured to allow the toner image to be transferred thereto from the image bearing member;

an intermediate transfer member drive unit configured to drive the intermediate transfer member by generating an assist torque for operating the intermediate transfer member to be driven;

a control unit configured to output a torque instruction value to the intermediate transfer member drive unit to control the assist torque generated by the intermediate transfer member drive unit; and a measurement unit configured to measure a maximum speed and a minimum speed of the surface of the image bearing member rotating, wherein the control unit controls the intermediate transfer member drive unit using a new torque instruction value determined based on torque instruction values respectively corresponding to a maximum speed and a minimum speed when controlling the intermediate transfer member drive unit so that the maximum speed and the minimum speed measured by the measurement unit are included in a range which is predetermined according to a target speed of the image bearing member.

12. The image forming apparatus according to claim 11, wherein the new torque instruction value is a median of the torque instruction value corresponding to the maximum speed and the torque instruction value corresponding to the minimum speed.

13. The image forming apparatus according to claim 11, wherein the control unit calculates the new torque instruction value when the image forming apparatus is activated.

14. The image forming apparatus according to claim 11, further comprising a speed detection unit configured to detect a rotation speed of the image bearing member.

15. The image forming apparatus according to claim 14, wherein the speed detection unit is a rotary encoder mounted on a rotational shaft of the image bearing member.

16. The image forming apparatus according to claim 14, wherein the control unit controls, based on a result of detection by the speed detection unit, the rotation speed of the image bearing member.

17. The image forming apparatus according to claim 11, further comprising an exposure unit configured to form an electrostatic latent image on a charged surface of the image bearing member by exposing the image bearing member.

18. The image forming apparatus according to claim 17, further comprising a position detection unit configured to detect a surface position of the image bearing member rotating.

19. The image forming apparatus according to claim 18, wherein the exposure unit exposes the image bearing member in synchronization with the surface position of the image bearing member based on a result of detection by the position detection unit.

20. The image forming apparatus according to claim 17, further comprising:

a developing unit configured to develop the electrostatic latent image on the image bearing member using toner;

a first transfer unit configured to transfer to the intermediate transfer member a toner image developed by the developing unit; and a second transfer unit configured to transfer to recording paper the toner image transferred to the intermediate transfer member by the first transfer unit.

* * * * *